US008082607B2

(12) United States Patent
Matsushita et al.

(10) Patent No.: US 8,082,607 B2
(45) Date of Patent: Dec. 27, 2011

(54) SANITARY CLEANSING APPARATUS AND TOILET APPARATUS

(75) Inventors: Hiroyuki Matsushita, Fukuoka-ken (JP); Hiroki Fujimura, Fukuoka-ken (JP); Saki Nakao, Fukuoka-ken (JP); Tatsuya Fukuda, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 558 days.

(21) Appl. No.: 12/279,106

(22) PCT Filed: Feb. 13, 2007

(86) PCT No.: PCT/JP2007/052522

§ 371 (c)(1),
(2), (4) Date: Dec. 23, 2008

(87) PCT Pub. No.: WO2007/094323

PCT Pub. Date: Aug. 23, 2007

(65) Prior Publication Data

US 2009/0217447 A1 Sep. 3, 2009

(30) Foreign Application Priority Data

Feb. 13, 2006 (JP) ..... 2006-034730
Feb. 13, 2006 (JP) ..... 2006-034731
May 31, 2006 (JP) ..... 2006-152868

(51) Int. Cl.
*E03D 9/08* (2006.01)

(52) U.S. Cl. ..... 4/420.5; 4/444; 4/313; 4/302

(58) Field of Classification Search ..... 4/420.5, 4/420.4, 420.2, 420.1, 443, 444, 447, 313, 4/302, 303, 304, 305

See application file for complete search history.

(56) References Cited

U.S. PATENT DOCUMENTS 4,616,368 A * 10/1986 Nagai et al. ..... 4/420.2
5,548,119 A * 8/1996 Nortier ..... 250/341.1
5,666,672 A * 9/1997 Birsel et al. ..... 4/236
5,878,444 A 3/1999 Convoy (Continued)

FOREIGN PATENT DOCUMENTS

CN 2060915 A 8/1990

(Continued)

OTHER PUBLICATIONS

International Search Report for PCT/JP2007/052522, dated Mar. 23, 2007.

(Continued)

*Primary Examiner* — Brian Glessner
*Assistant Examiner* — Rodney Mintz
(74) *Attorney, Agent, or Firm* — Pearne & Gordon LLP

(57) ABSTRACT

A sanitary cleansing apparatus includes: a main body incorporating a water discharge nozzle that squirts water from a water discharge port; a toilet seat rotatably and pivotally supported at a relatively anterior position of the main body; a toilet lid rotatably and pivotally supported at a relatively posterior position of the main body and generally entirely covering an upper face of the toilet seat and the main body in a closed state; a transmissive window provided at a rear of the toilet lid and formed from a material different from that of the toilet lid; and a human body detection sensor provided in the upper face of the main body and being capable of detecting a human body through the transmissive window in the closed state of the toilet lid.

16 Claims, 39 Drawing Sheets

U.S. PATENT DOCUMENTS

| | | | | |
|---|---|---|---|---|
| 6,219,857 | B1 * | 4/2001 | Wu | 4/623 |
| 6,675,399 | B1 | 1/2004 | Tomita et al. | |
| 6,880,180 | B2 * | 4/2005 | Hayashi et al. | 4/313 |
| 6,966,076 | B2 * | 11/2005 | Kamysz et al. | 4/243.2 |
| 7,036,159 | B2 | 5/2006 | Tomita et al. | |
| 7,051,381 | B2 * | 5/2006 | Furukawa et al. | 4/246.1 |
| 7,971,368 | B2 * | 7/2011 | Fukaya et al. | 34/77 |
| 2003/0019023 | A1 | 1/2003 | Furukawa et al. | |
| 2004/0164261 | A1 * | 8/2004 | Parsons et al. | 251/129.04 |
| 2005/0217010 | A1 * | 10/2005 | Hayashi et al. | 4/246.1 |
| 2005/0246828 | A1 * | 11/2005 | Shirai et al. | 4/420.4 |
| 2006/0117473 | A1 * | 6/2006 | Zeferino | 4/233 |
| 2010/0071120 | A1 * | 3/2010 | Ghardi et al. | 4/217 |
| 2011/0030133 | A1 * | 2/2011 | Morotomi et al. | 4/443 |
| 2011/0072570 | A1 * | 3/2011 | Morotomi et al. | 4/420.2 |
| 2011/0173744 | A1 * | 7/2011 | Fukuzato et al. | 4/443 |

FOREIGN PATENT DOCUMENTS

| | | | |
|---|---|---|---|
| JP | 01-270831 | | 10/1989 |
| JP | 04-24219 | | 2/1992 |
| JP | 11-098583 | | 4/1999 |
| JP | 11-172741 | A | 6/1999 |
| JP | 2001-107435 | | 4/2001 |
| JP | 2003-235761 | | 8/2003 |
| JP | 2003-265360 | | 9/2003 |
| JP | 2003-268855 | A | 9/2003 |
| JP | 2003-314602 | | 11/2003 |
| JP | 2004-065540 | | 3/2004 |
| JP | 2004-232404 | | 8/2004 |
| JP | 2004-267348 | | 9/2004 |
| JP | 2004-275268 | A | 10/2004 |
| JP | 2005-177223 | A | 7/2005 |
| JP | 2006-002495 | | 1/2006 |

OTHER PUBLICATIONS

European Search Report for 07 71 4104 dated Feb. 17, 2011.

* cited by examiner

SANITARY CLEANSING APPARATUS AND TOILET APPARATUS

TECHNICAL FIELD

This invention relates to a sanitary cleansing apparatus and a toilet apparatus, and more particularly to a sanitary cleansing apparatus provided with a reclosable toilet lid and a toilet apparatus provided therewith.

BACKGROUND ART

A sanitary cleansing apparatus retractably houses therein a water discharge nozzle for squirting wash water. The sanitary cleansing apparatus is placed on a sit-down toilet bowl so that the user's "bottom" can be cleansed with warm water. Typically, a toilet seat allowing a user to sit thereon and a toilet lid covering it are reclosably and pivotally supported on the sanitary cleansing apparatus (e.g., Patent Documents 1 and 2).

On the other hand, many sanitary cleansing apparatuses include a human body detection sensor for detecting the access or presence of a user. On the basis of the detection result of the human body detection sensor, when a user enters or leaves the toilet, the toilet lid can be automatically opened/closed, the toilet bowl can be automatically flushed with wash water, and the temperature of the toilet seat and wash water can be controlled. Recently, an apparatus has been developed for automatically opening/closing the toilet seat and toilet lid by a motor (Patent Document 3).

Patent Document 1: JP 2003-265360A
Patent Document 2: JP 2004-267348A
Patent Document 3: JP 1-270831A (1989)

DISCLOSURE OF INVENTION

Problems to be Solved by the Invention

If the toilet lid in its closed state covers not only the toilet seat but also the main body of the sanitary cleansing apparatus, a sleek appearance is achieved. Furthermore, the toilet lid eliminates gaps through which dust may intrude. Moreover, the toilet lid can improve cleanability in wipe and other cleaning.

However, the toilet lid covering up to the main body of the sanitary cleansing apparatus causes a problem of shielding light in the detection range of an infrared transmission human body detection sensor. For this reason, as described in Patent Document 2, the human body detection sensor needs to be projected laterally from the sanitary cleansing apparatus, or to be exposed by providing a notch at the rear of the toilet lid. However, such configuration contrarily deteriorates the appearance and decreases the cleanability of the sanitary cleansing apparatus.

On the other hand, whether the toilet lid is opened/closed manually or electrically, the open-end angle, or maximum opening angle, of the toilet lid is widely varied depending on the installation site. More specifically, in the case of a toilet of the low-tank type, a low tank is located behind the toilet lid. In the case of a toilet of the service-water direct-pressure type without a low tank, a shelf or bay window of the toilet may be located behind the toilet bowl.

This invention provides a sanitary cleansing apparatus that can be substantially entirely covered with a toilet lid and that can also reliably perform human body detection, and a toilet apparatus provided therewith.

Furthermore, this invention provides a toilet seat apparatus capable of preventing collision with an object therebehind at the time of opening the toilet lid, and a toilet apparatus provided therewith.

Solution to the Problems

According to an aspect of the invention, there is provided a sanitary cleansing apparatus including: a main body incorporating a water discharge nozzle that squirts water from a water discharge port; a toilet seat rotatable and pivotally supported at a relatively anterior position of the main body; a toilet lid rotatably and pivotally supported at a relatively posterior position of the main body and generally entirely covering an upper face of the toilet seat and the main body in a closed state; a transmissive window provided at a rear of the toilet lid and formed from a material different from that of the toilet lid; a human body detection sensor provided in the upper face of the main body and being capable of detecting a human body through the transmissive window in the closed state of the toilet lid.

According to another aspect of the invention, there is provided a toilet apparatus including: a sit-down toilet bowl; and the sanitary cleansing apparatus described above.

BRIEF DESCRIPTION OF DRAWINGS

FIG. 4 shows the closed state of the toilet lid 300

FIG. 5 shows the opened state of the toilet lid 300.

FIG. 6 shows the opened state of the toilet lid 300.

DESCRIPTION OF REFERENCE NUMERALS

Figure 1:
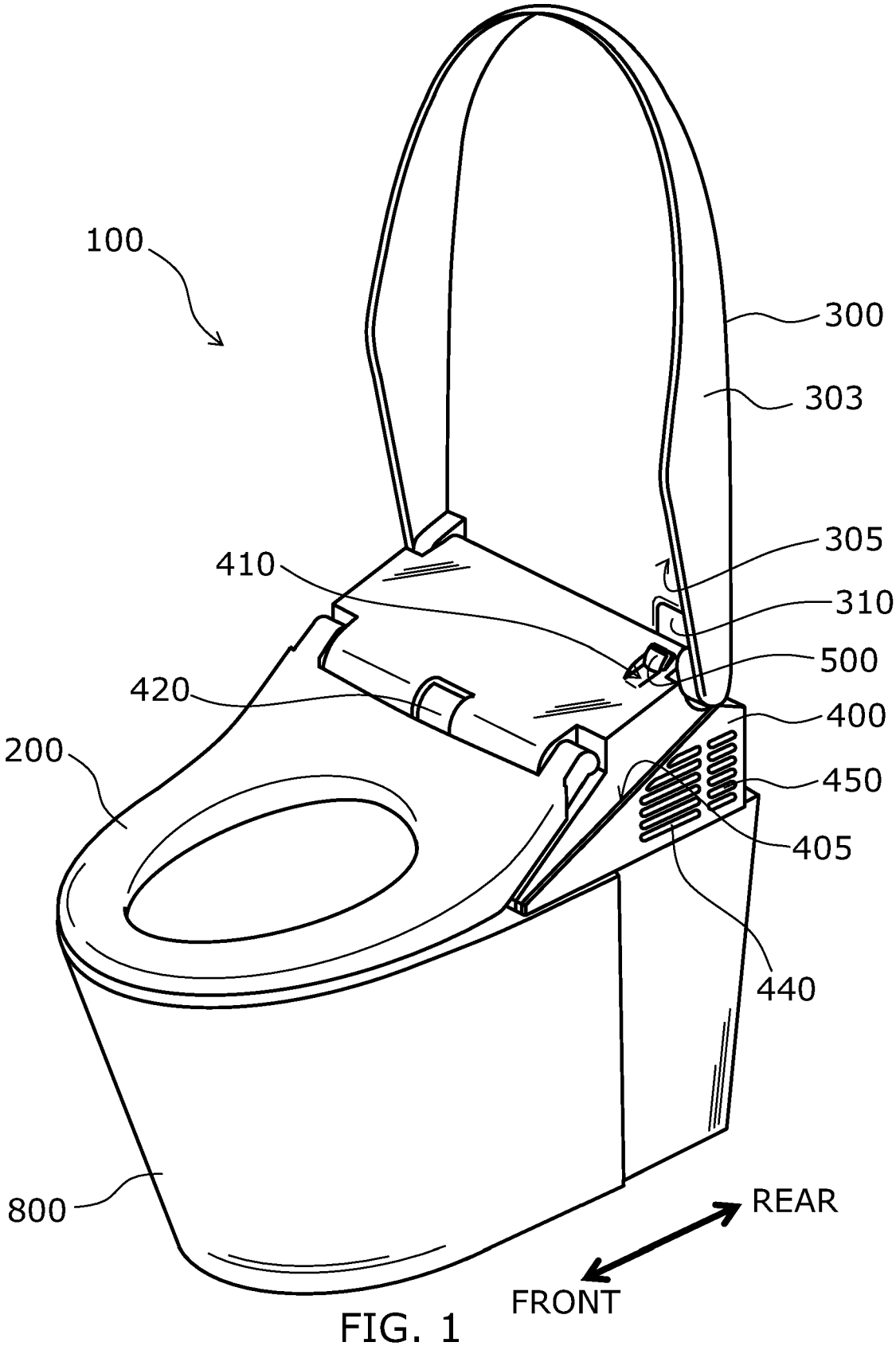
FIG. 1 is a schematic perspective view of a toilet apparatus equipped with a sanitary cleansing apparatus according to the embodiment of the invention.

100 sanitary cleansing apparatus
200 toilet seat
300 toilet lid
302 backside
303 sidewall
305 rear lower edge
310 transmissive window
312 rail groove
314 hook
320 window portion
330 flange portion
340 opening
350 rail
360 support bridge
365 hooking recess
370 pivotal support
372 opening edge
380 rotation axis
400 main body
402 curved concave surface
404 extension
405 step
408 slope
410 recessed portion
420 seating sensor
430 case cover
440 exhaust port
450 ejection hole
460 nozzle damper
470 warm air damper
480 stopper
500 human body detection sensor
510 pyroelectric element
520 lens
530 substrate
580 light-receiving window
610 nozzle unit
620 warm air unit
630 deodorizing unit
640 controller
650 pump unit
660 heat exchange unit
670 display portion
680 auxiliary control unit
690 valve unit
700 controller
710 driver unit
720 toilet lid opening/closing unit
721 motor
722 deceleration mechanism
724 angle stopper
725 angle detector
726 assist spring
728 rotation shaft
730 toilet bowl washing valve unit
735 feedwater piping
740 room heating unit
760 toilet bowl side baseplate
770 installation board
772 pin
775 opening
780 toilet seat opening/closing unit
792 lamp
793 window
800 toilet bowl
810 bowl
900 remote controller
902 main body
904 cover
906 infrared emitter

950 rear wall
960 protruding body

BEST MODE FOR CARRYING OUT THE INVENTION

An embodiment of the invention will now be described with reference to the drawings.

Figure 2:
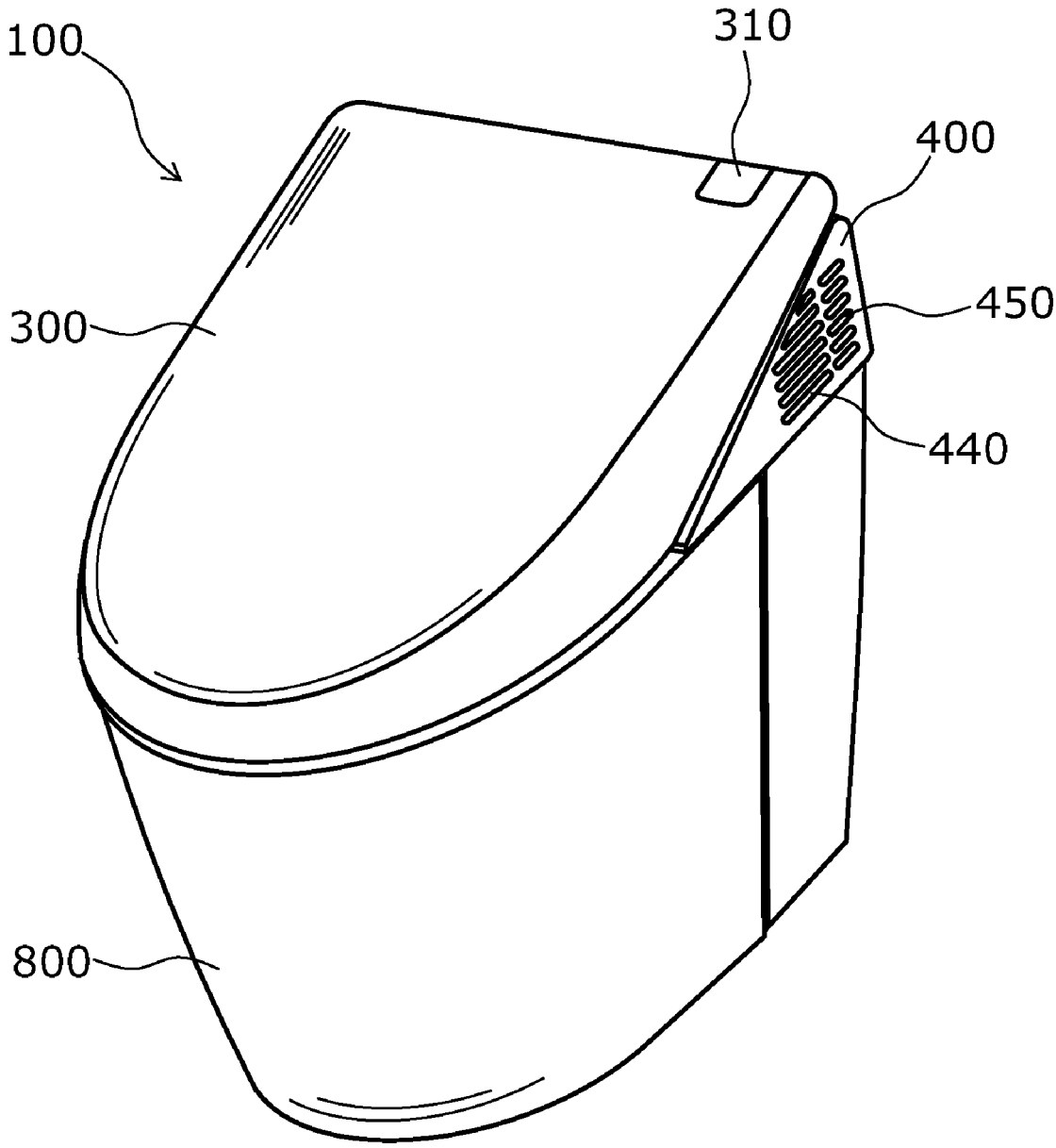
FIG. 2 is a schematic perspective view of a toilet apparatus equipped with a sanitary cleansing apparatus according to the embodiment of the invention.

FIGS. 1 and 2 are schematic perspective views of a toilet apparatus equipped with a sanitary cleansing apparatus according to the embodiment of the invention.

Figure 3:
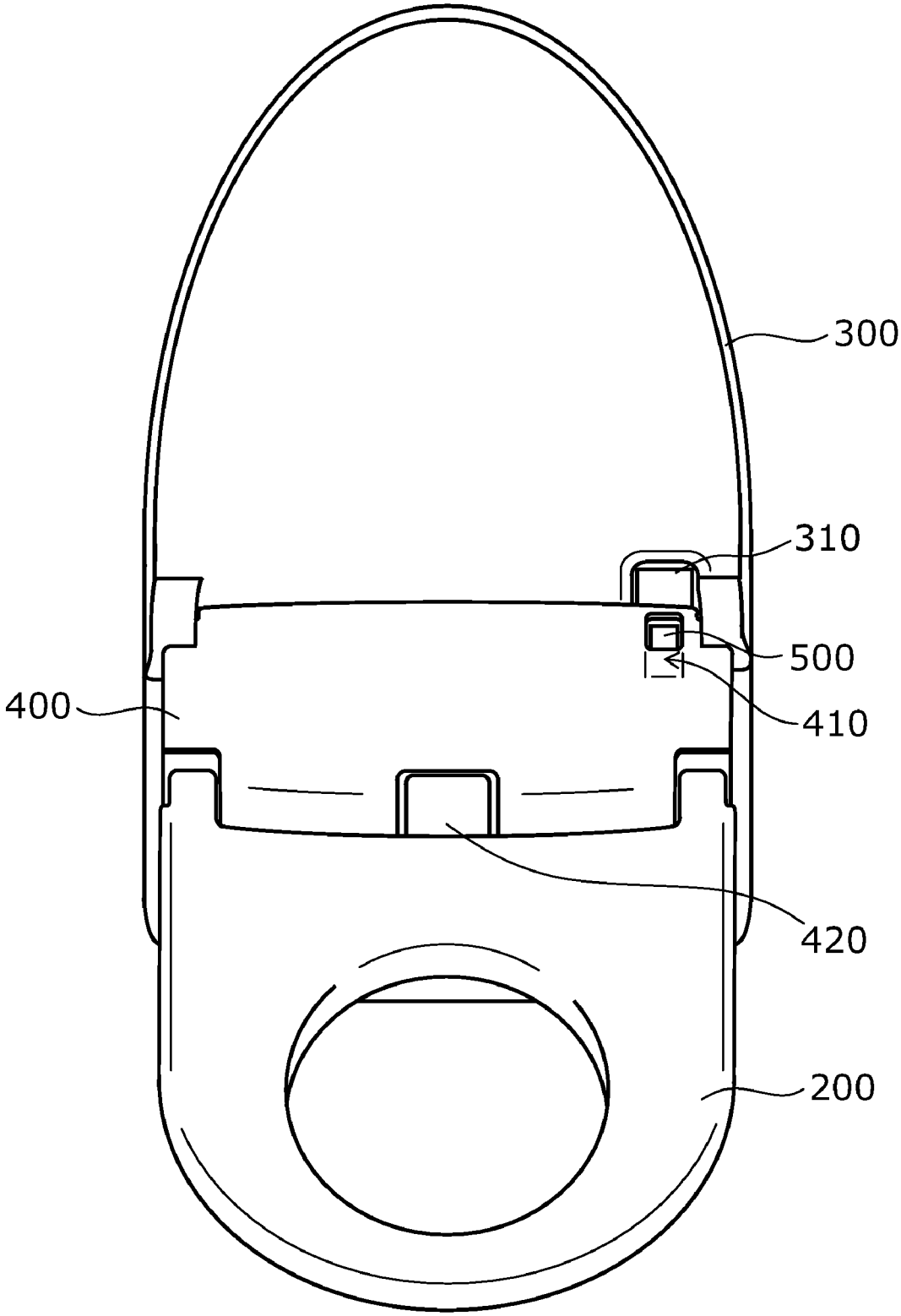
FIG. 3 is a perspective view of the sanitary cleansing apparatus of this example as viewed from the front.

FIG. 3 is a perspective view of the sanitary cleansing apparatus of this example as viewed from the front.

More specifically, a sanitary cleansing apparatus 100 is placed on a sit-down toilet bowl 800. The sanitary cleansing apparatus 100 comprises a main body 400, and a toilet seat 200 and a toilet lid 300 reclosably and pivotally supported on the main body 400. From the main body 400, a water discharge nozzle (not shown) extends out into the bowl of the toilet bowl 800 in response to user's switch manipulation and squirts water from a water discharge port provided near its tip so that the user's "bottom" can be cleansed. The term "water" used herein includes not only cold water but also heated warm water. The main body 400 is suitably provided with various mechanisms such as a "deodorizing unit", "warm air unit", and "room heating unit". An exhaust port 440 and an ejection hole 450 are suitably provided on the side face of the main body 400. The internal configuration of the main body 400 is described later in detail.

The toilet seat 200 is pivotally supported on the main body 400 relatively anteriorly, whereas the toilet lid 300 is pivotally supported on the main body 400 relatively posteriorly. That is, the rotary shaft of the toilet seat 200 is spaced longitudinally from the rotary shaft of the toilet lid 300. As shown in FIGS. 1 and 3, in the opened state of the toilet lid 300, the main body 400 and the toilet seat 200 are exposed nearly completely, and a user can sit on the toilet seat 200 without interfering with the toilet lid 300. By pivotally supporting the toilet lid 300 at the rear of the main body 400, the toilet lid 300 can be distanced from the user sitting on the toilet seat 200. Consequently, this allows a user sitting on the toilet seat 200 to experience a feeling of openness and to enjoy comfortable use. Furthermore, even when the user sits on the toilet seat 200 with a heavy jacket or tall dress rolled up, for example, the jacket or dress is less prone to contact with the toilet lid 300, and the user is free from a feeling of oppression or sanitary discomfort.

On the other hand, as shown in FIG. 2, when the toilet lid 300 is closed, the toilet lid 300 nearly completely covers not only the toilet seat 200 but also the main body 400. If the sanitary cleansing apparatus is nearly entirely covered with the toilet lid 300 in this manner, a very smart, simple, and a sleek appearance is achieved. By entirely covering the sanitary cleansing apparatus 100 with the toilet lid 300, no dirt or dust accumulates on the main body 400 as well as on the toilet seat 200 while not in use. Furthermore, in the closed state of the toilet lid 300, the upper face of the sanitary cleansing apparatus 100 has no "gaps" and "irregularities". Hence, in wipe cleaning with a damp cloth, the entire upper face of the toilet lid 300 can be smoothly and quickly wiped, achieving good cleanability.

In this example, a step 405 (see also FIG. 5) is formed on the side face of the main body 400. In the closed state of the toilet lid 300, the step 405 fits the rear lower edge 305 of the toilet lid 300 in abutment or proximity, and the side face of the main body 400 and the side face of the toilet lid 300 form a nearly continuous common surface. Consequently, in the closed state of the toilet lid 300, a continuous plane extending from the toilet lid 300 to the main body 400 is formed also on the side face of the sanitary cleansing apparatus 100. This further makes the appearance sleek and also prevents accumulation of dust and dirt. Furthermore, in the closed state of the toilet lid 300, the side face of the sanitary cleansing apparatus 100 can be wipe cleaned smoothly and quickly without causing a damp cloth to get stuck.

The main body 400 of the sanitary cleansing apparatus of this embodiment has an upper face between the pivotal support of the toilet seat 200 and the pivotal support of the toilet lid 300, the upper face being generally parallel to the toilet lid 300 in the closed state. A human body detection sensor 500 is provided in the upper face. On the other hand, a transmissive window 310 is provided at the rear of the toilet lid 300.

Figure 4:
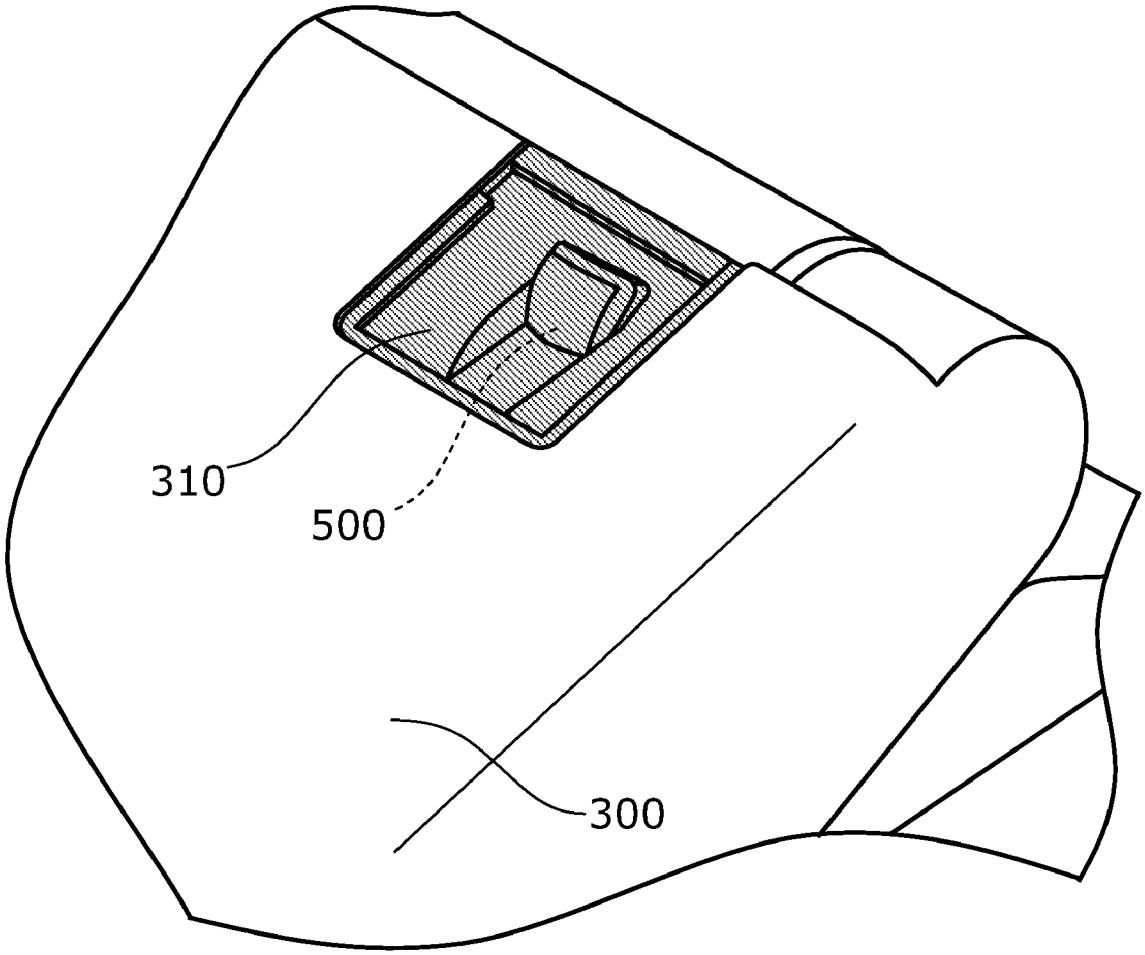
FIG. 4 is enlarged perspective view showing the installation portion of the human body detection sensor 500, where
Figure 5:
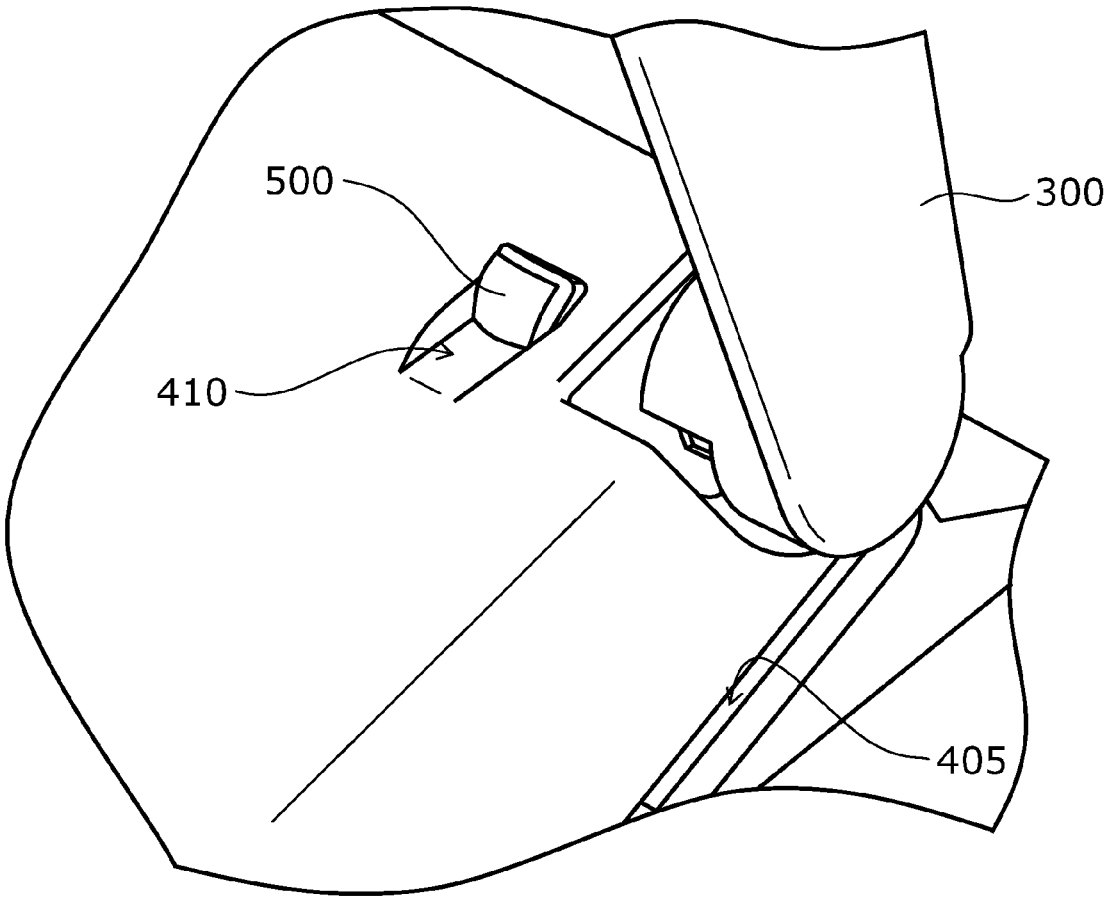
FIG. 5 is enlarged perspective view showing the installation portion of the human body detection sensor 500, where
Figure 6:
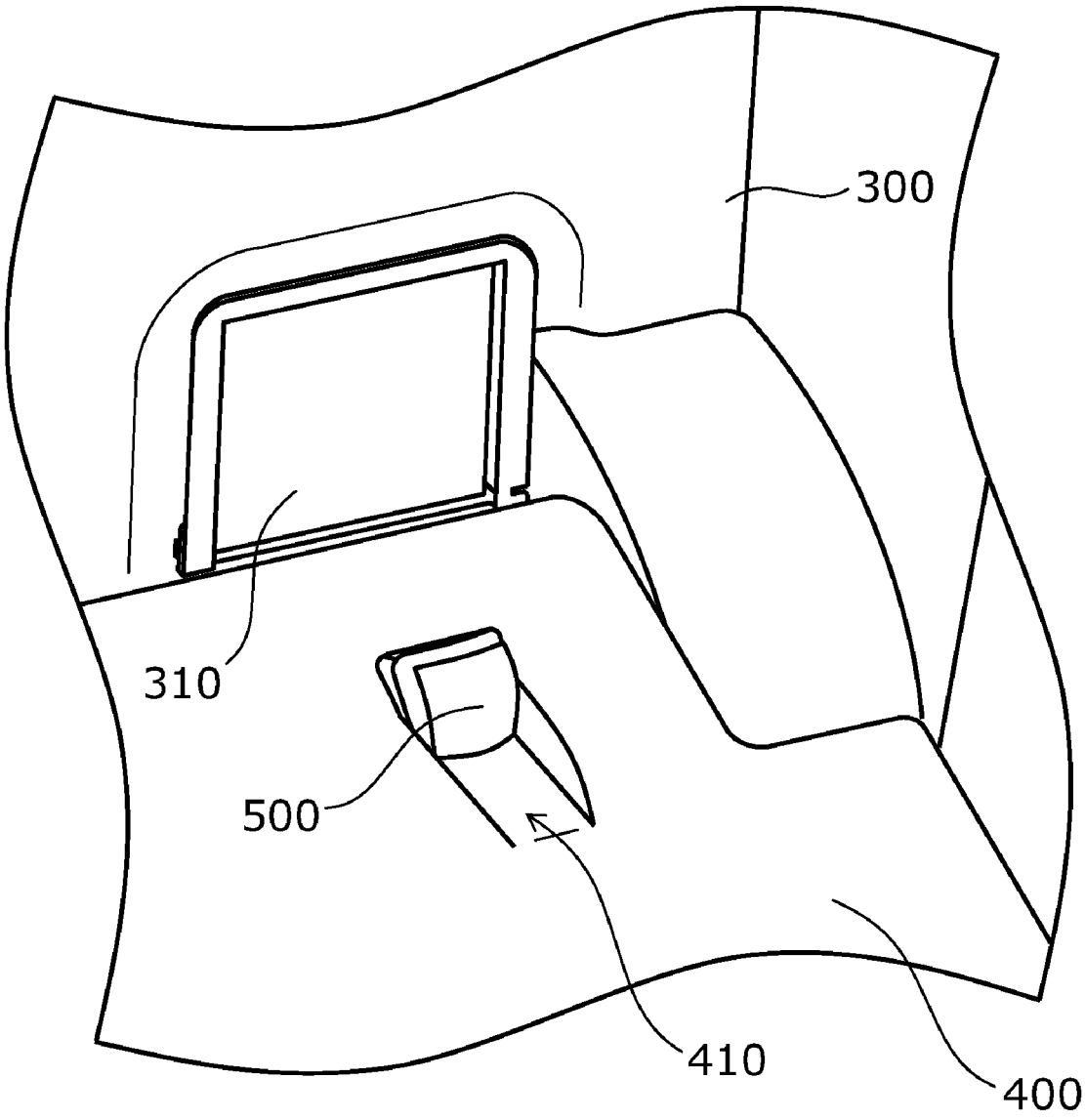
FIG. 6 is enlarged perspective view showing the installation portion of the human body detection sensor 500, where

FIGS. 4 to 6 are enlarged perspective views showing the installation portion of the human body detection sensor 500, where FIG. 4 shows the closed state of the toilet lid 300 and FIGS. 5 and 6 show the opened state of the toilet lid 300.

Figure 7:
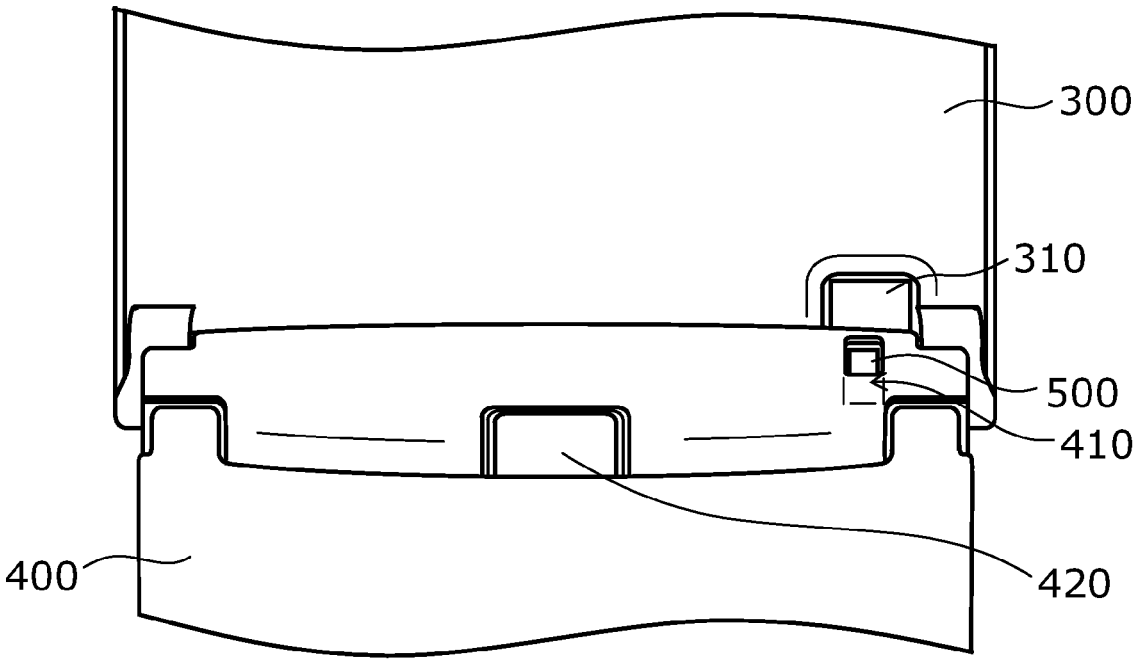
FIG. 7 is an enlarged perspective view of the pivotal support of the toilet lid 300 in its opened state as viewed from the front.

FIG. 7 is an enlarged perspective view of the pivotal support of the toilet lid 300 in its opened state as viewed from the front.

A recessed portion 410 is formed in the upper face of the main body 400, and the human body detection sensor 500 is provided so that a portion thereof is embedded in the recessed portion 410. As described later in detail, the human body detection sensor 500 can be an infrared detection sensor. For example, a pyroelectric sensor can be used to detect the presence of a user with high accuracy. It is known that the pyroelectric sensor can detect movement of a heat-generating body within a prescribed detection range in front thereof.

As shown in FIG. 4, in the closed state of the toilet lid 300, the human body detection sensor 500 detects the presence of a user located in front of the sanitary cleansing apparatus through the transmissive window 310. That is, the transmissive window 310 transmits infrared radiation to be detected by the human body detection sensor 500. When a pyroelectric sensor, for example, is used as the human body detection sensor 500, the pyroelectric sensor detects far-infrared radiation with a wavelength of approximately 10 micrometers. Hence the transmissive window 310 is made of a material having a certain transmissivity for infrared radiation in this wavelength band. By using polyethylene, for example, as the material of the transmissive window 310, the access or presence of a user can be detected through the transmissive window 310 with high sensitivity even in the closed state of the toilet lid 300.

On the other hand, the toilet lid 300 supporting the transmissive window 310 can be formed from a material having a lower transmissivity for infrared radiation than the transmissive window 310. If the toilet lid 300 is formed from a harder and more robust material than the transmissive window 310, the toilet lid 300 has a small deflection and deformation and is less susceptible to scratches. Furthermore, the color of the toilet lid 300 can be freely chosen and easily adapted to the color of the toilet bowl 800 and the main body 400. An example material of the toilet lid 300 satisfying these requirements is polypropylene.

In the closed state of the toilet lid 300, when the human body detection sensor 500 detects a user, the toilet lid 300 can be automatically opened by, for example, activating a toilet lid opening/closing unit incorporated in the main body 400. Furthermore, it is possible to perform processes such as rapidly heating the toilet seat 200, warming the toilet by activating a room heating unit provided in the main body 400, and preventing the attachment of dirt by previously flushing the toilet bowl 800 with a small amount of wash water to wet the bowl.

As shown in FIGS. 5 and 6, when the toilet lid 300 is opened, no shielding body is located in front of the human body detection sensor 500. Hence the human body detection sensor 500 can directly detect the presence of a user. Furthermore, the main body 400 is provided with a seating sensor 420, enabling detection of the presence of a user sitting on the toilet seat 200. The seating sensor 420 can be an infrared sensor operable to emit infrared radiation and to detect the reflected light intensity, for example.

Figure 8:
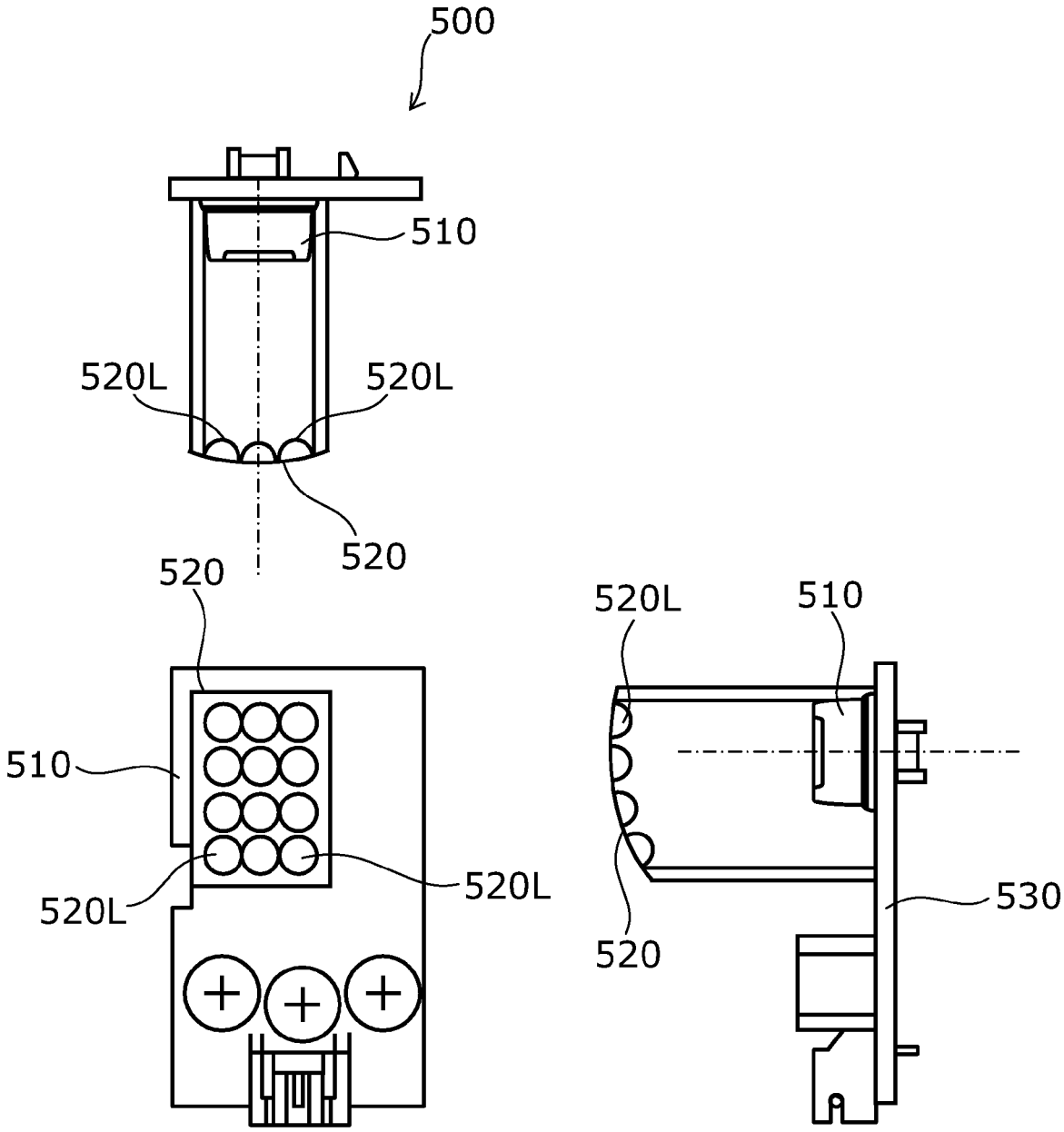
FIG. 8 is a partially enlarged vertical cross-sectional views of the main body 400 with the human body detection sensor 500 embedded therein.

FIG. 8 is a schematic view illustrating the structure of the human body detection sensor 500. More specifically, FIG. 8 shows the structure using a pyroelectric sensor as the human body detection sensor 500.

The pyroelectric sensor includes a pyroelectric element 510 mounted on a substrate 530 and a lens 520 opposed to the light receiving surface of the pyroelectric element 510. The pyroelectric element 510 is illustratively made of a pyroelectric material based on PZT (lead zirconate titanate), $LiTaO_3$ (lithium tantalate), or $PbTaO_3$ (lead tantalate), and partitioned into a plurality of detection regions. The lens 520 is also partitioned into a plurality of lens portions 520L. When a heat-generating source such as a human body moves, the focusing pattern of infrared radiation by these lens bodies 520 also moves on the light receiving surface of the pyroelectric element 510, and hence its change can be detected.

Figure 9:
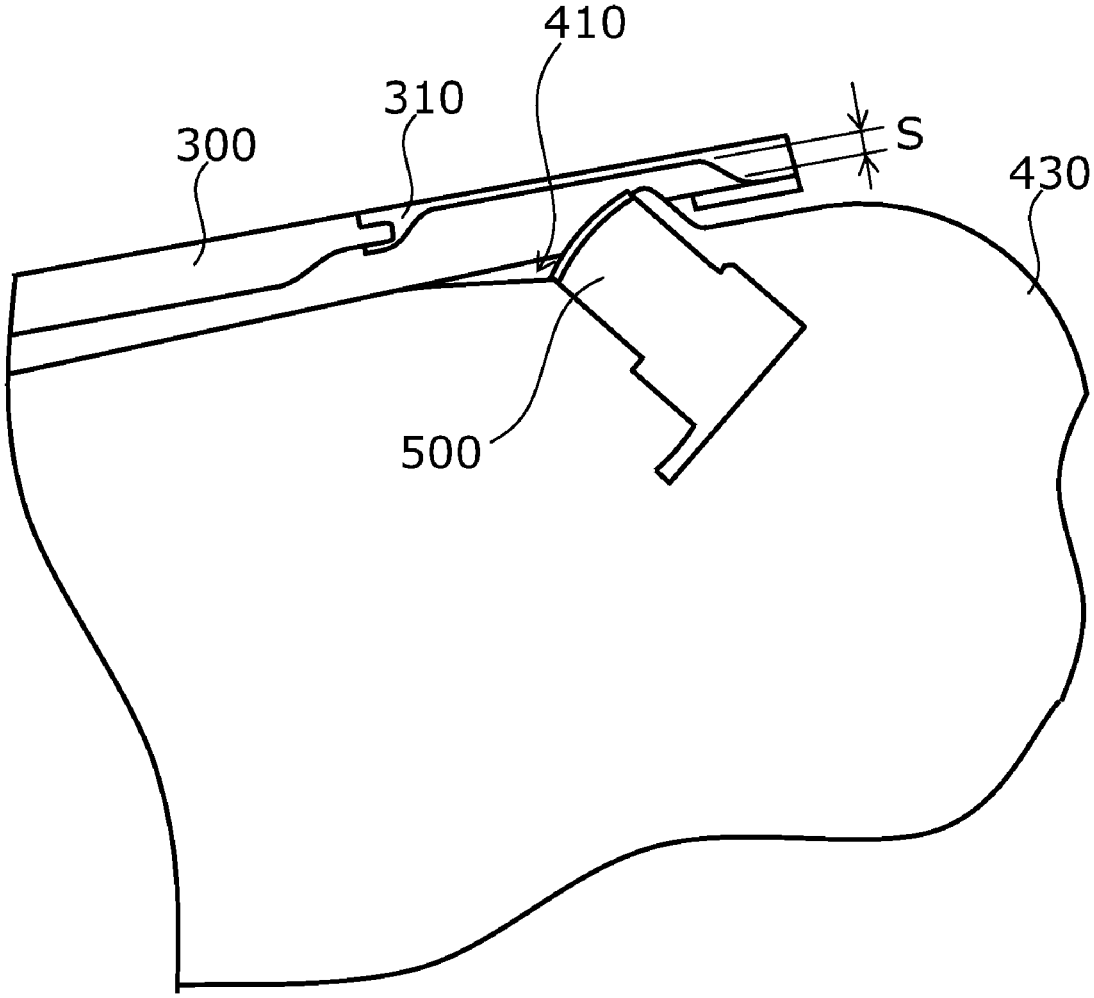
FIG. 9 is a partially enlarged vertical cross-sectional view of the main body 400 with the human body detection sensor 500 embedded therein.

FIG. 9 is a partially enlarged vertical cross-sectional view of the main body 400 with the human body detection sensor 500 embedded therein.

In this example, as shown in FIG. 9, the human body detection sensor 500 is provided in proximity to the rear of the case cover 430 on the upper face of the main body 400, that is, to the pivotal support of the toilet lid 300, so as to slightly protrude from the upper face of the main body 400. Thus the distance between the transmissive window 310 and the human body detection sensor 500 can be reduced. Consequently, a wide range can be detected while downsizing the transmissive window 310. That is, a wide-angle range can be detected through the small transmissive window 310 as viewed from the human body detection sensor 500.

As described above, the transmissive window 310 needs to be formed from a material having a higher transmissivity for infrared radiation than the toilet lid 300. Thus the transmissive window 310 may be different in color and texture from the toilet lid 300, or may be susceptible to deformations and scratches due to low hardness. Even in such cases, according to this embodiment, the transmissive window 310 can be downsized and provided near the rear edge of the toilet lid 300. Hence the transmissive window 310 is obscured, and the effect of preventing deformation and scratching is also achieved because it is less prone to being touched by hands.

Furthermore, as shown in FIG. 9, by providing a recessed portion 410 in the main body 400 and embedding part of the human body detection sensor 500 in the recessed portion 410, a wide angle can be detected without significantly projecting the human body detection sensor 500 from the upper face of the case cover 430 of the main body. That is, human body detection can be reliably performed while maintaining cleanability of the upper face of the case cover 430.

Figure 10:
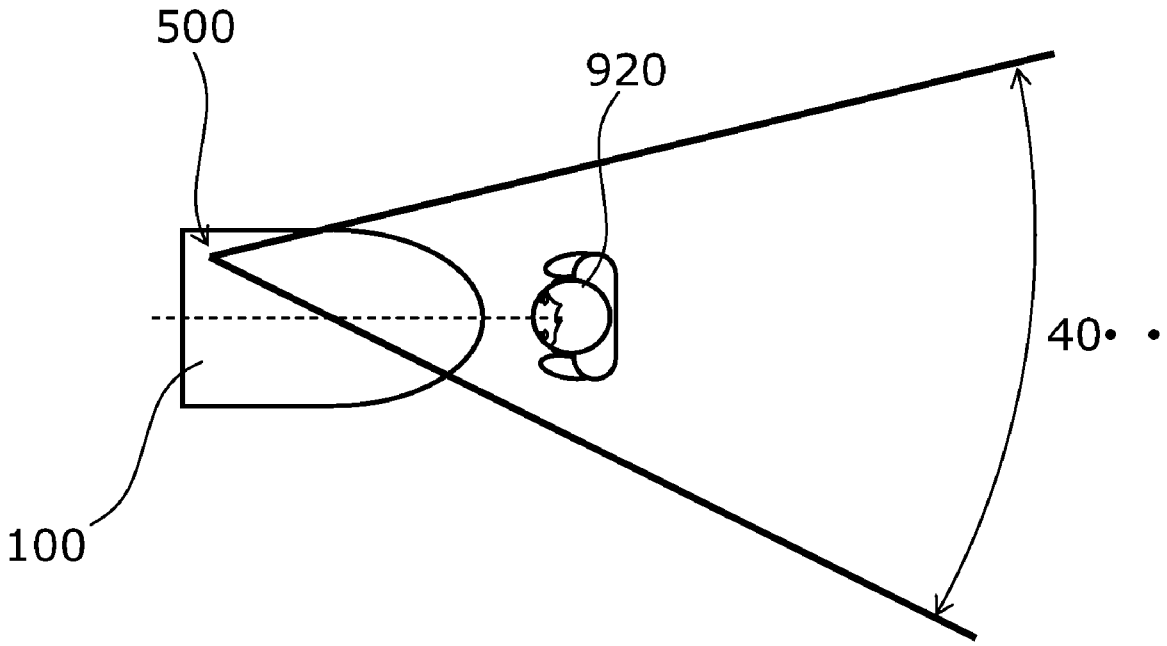
FIG. 10 is a schematic view illustrating the range where a human body can be detected by the human body detection sensor 500 in the sanitary cleansing apparatus 100 of this example.
Figure 11:
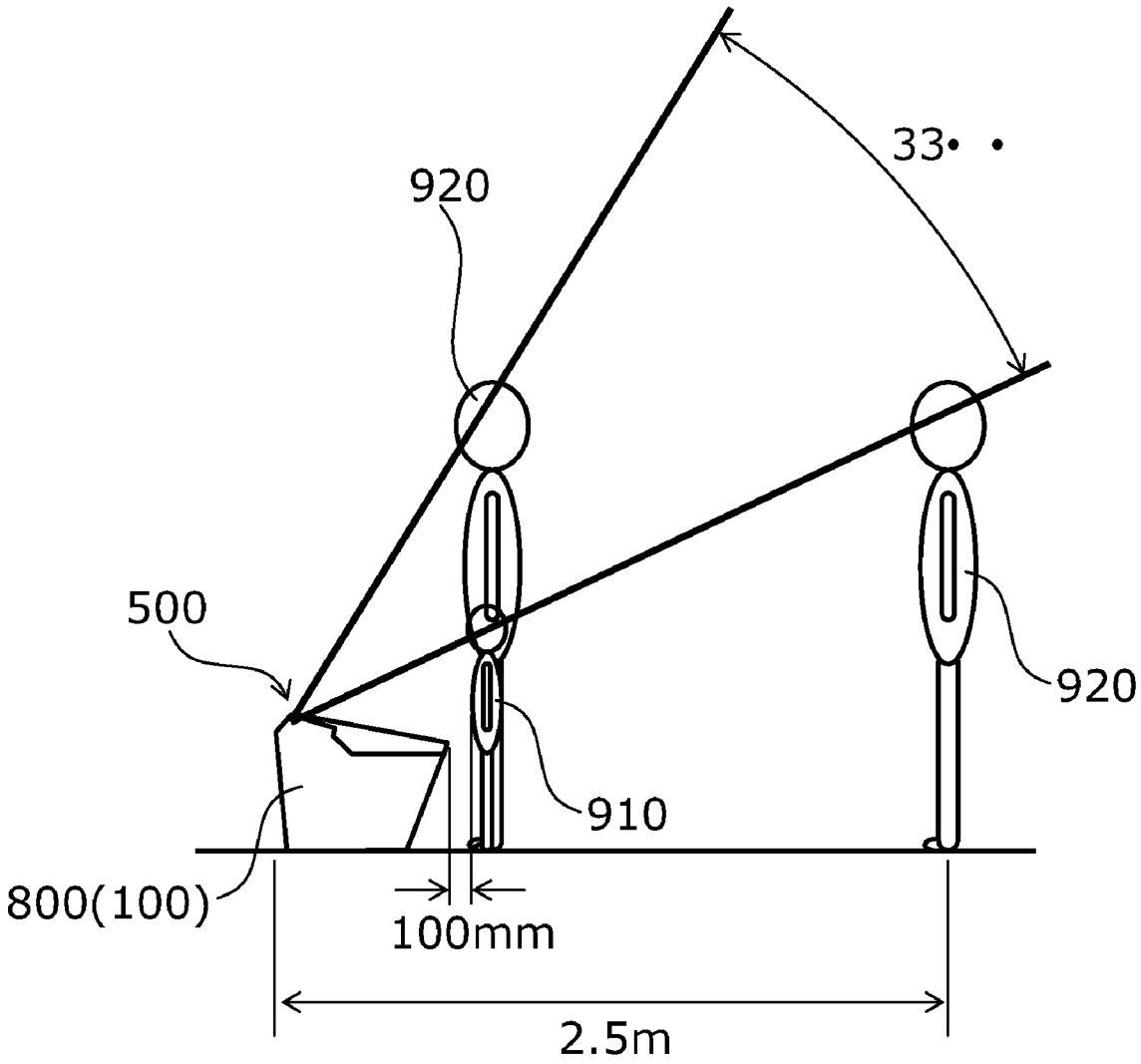
FIG. 11 is a schematic view illustrating the range where a human body can be detected by the human body detection sensor 500 in the sanitary cleansing apparatus 100 of this example.

FIGS. 10 and 11 are schematic views illustrating the range where a human body can be detected by the human body detection sensor 500 in the sanitary cleansing apparatus 100 of this example. More specifically, FIGS. 10 and 11 show horizontal and vertical detectable ranges, respectively.

As seen from FIG. 10, the human body detection sensor 500 can detect a human body 920 within a horizontal range of 40 degrees. On the other hand, as seen from FIG. 11, a human body 920 located in upper front of the sanitary cleansing apparatus can be detected within a vertical range of 33 degrees. These ranges are sufficient for detecting the presence of a user approaching the sanitary cleansing apparatus 100 or a user standing in front of the sanitary cleansing apparatus 100 in a standard-sized toilet. As shown in FIG. 11, an adult 920 of ordinary stature can be detected when he/she comes to a distance of 2.5 meters from the rear edge of the toilet bowl 800. Furthermore, the head of an adult 920 of ordinary stature can be also detected when he/she stands directly in front of the toilet bowl 800. In general, even a child 910 a little less than one meter tall being able to use a toilet alone can be detected when he/she comes to approximately 100 millimeters from the front edge of the sanitary cleansing apparatus 100. Of course, the head of the child 910 standing directly in front of the toilet bowl 800 can be also detected. That is, the presence of users ranging from adults to children using the toilet bowl 800 (sanitary cleansing apparatus 100) can be reliably detected.

Next, the transmissive window 310 and its installation structure used in this example are described in more detail.

Figure 12:
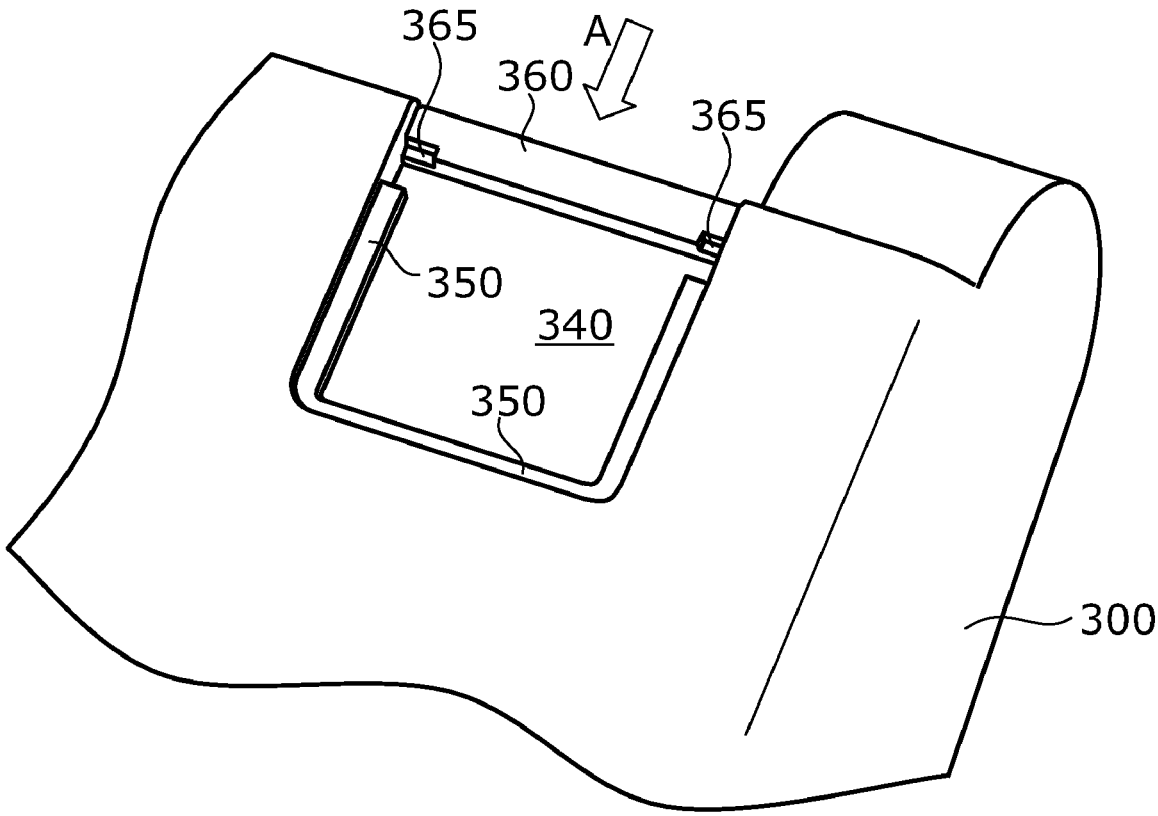
FIG. 12 is a perspective view showing the installation portion of the toilet lid 300 where the transmissive window 310 is installed.

FIG. 12 is a perspective view showing the installation portion of the toilet lid 300 where the transmissive window 310 is installed.

At the rear edge of the toilet lid 300, an opening 340 for installing the transmissive window 310 is formed. Laminated rails 350 are provided on the front, left, and right sidewall of the opening 340. On the other hand, a support bridge 360 is provided at the rear edge of the opening 340. The transmissive window 310 is slidably inserted from the rear side of the toilet lid 300 and passed above the support bridge 360 along the rails 350 in the direction of arrow A.

Figure 13:
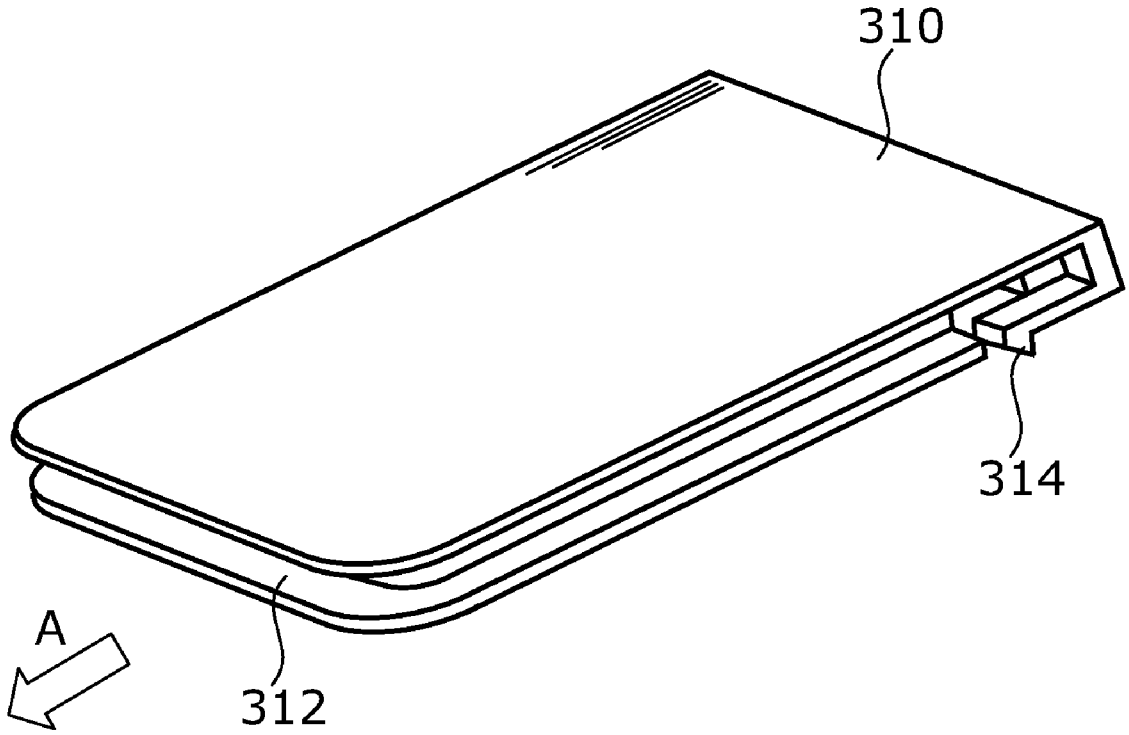
FIG. 13 is a perspective view of the transmissive window 310 as viewed from obliquely above.

FIG. 13 is a perspective view of the transmissive window 310 as viewed from obliquely above.

Figure 14:
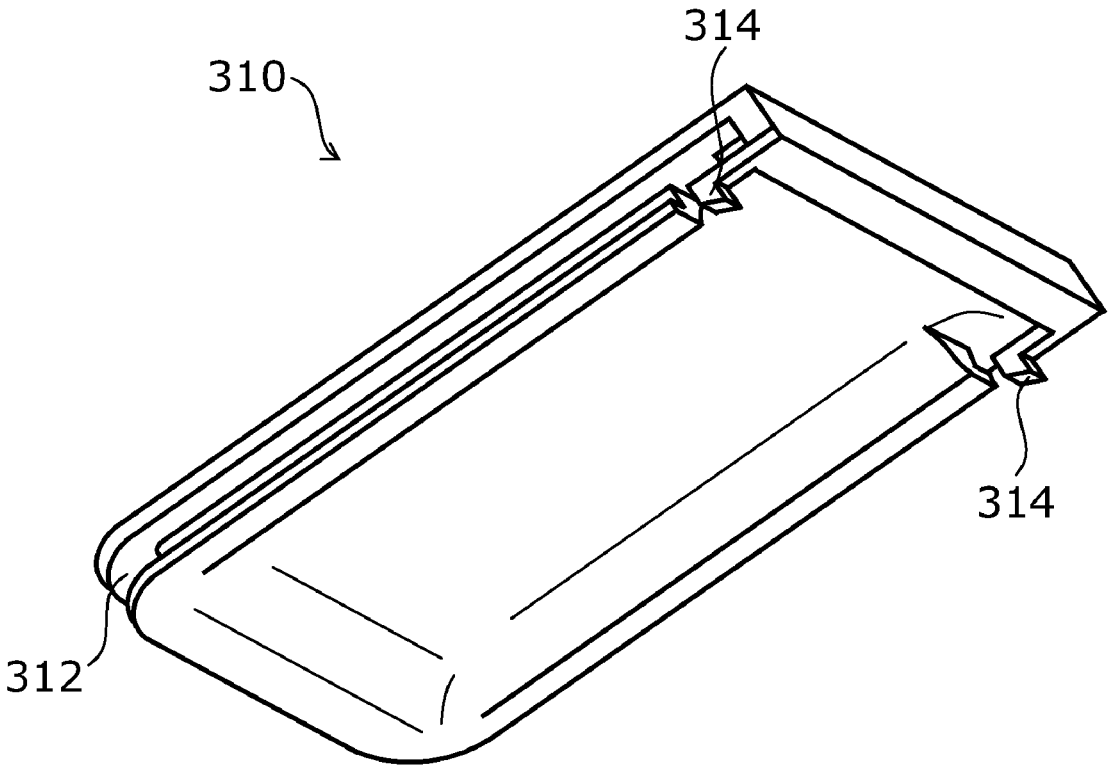
FIG. 14 is a perspective view of the transmissive window 310 as viewed from obliquely below.

FIG. 14 is a perspective view of the transmissive window 310 as viewed from obliquely below.

Figure 15:
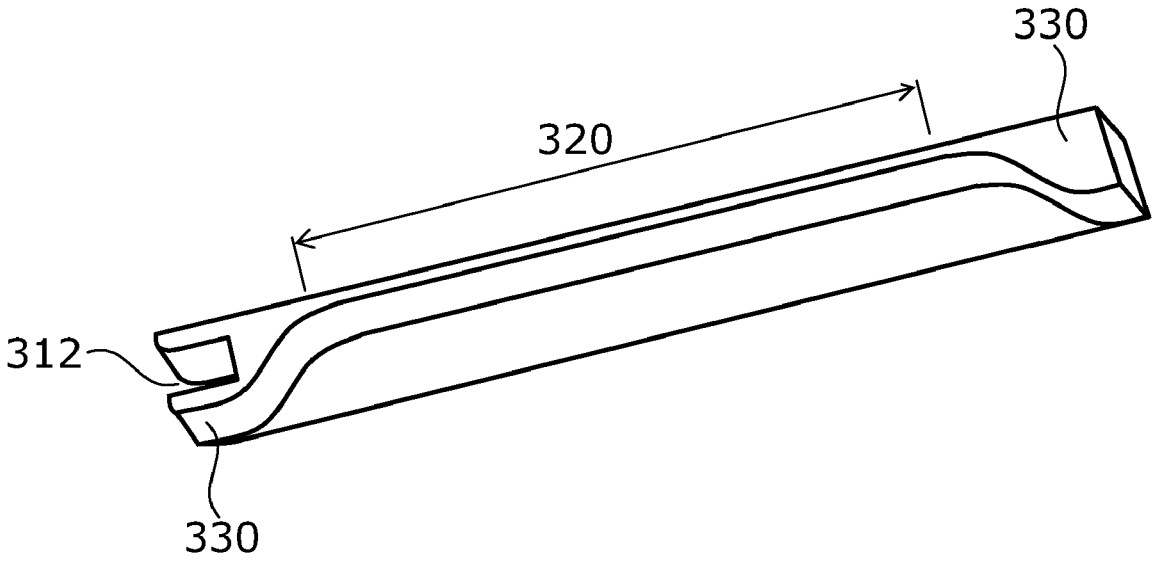
FIG. 15 is a cross-sectional perspective view of the transmissive window 310 cut horizontally.

FIG. 15 is a cross-sectional perspective view of the transmissive window 310 cut horizontally.

Figure 16:
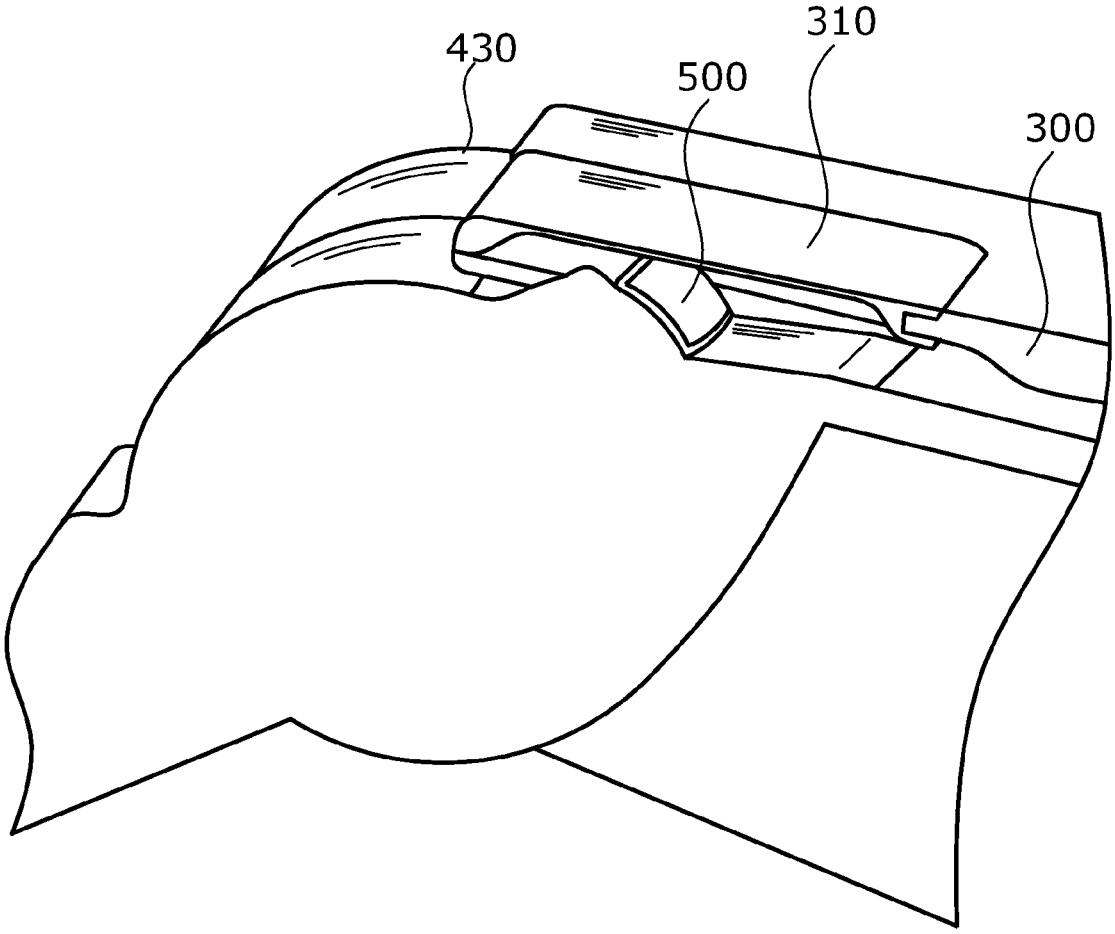
FIG. 16 is an enlarged cross-sectional view showing a cross section of the installation portion of the transmissive window 310.

FIG. 16 is an enlarged cross-sectional view showing a cross section of the installation portion of the transmissive window 310.

On the front, left, and right side face of the transmissive window 310, rail grooves 312 to engage with the rails 350 of the toilet lid 300 are provided. As shown by arrow A in FIGS. 12 and 13, the transmissive window 310 can be installed so as to occlude the opening 340 by being slid forward from the rear edge of the toilet lid 300 while engaging the rail grooves 312 with the rails 350 on both lateral edges. When the transmissive window 310 is slid to the front edge, the rail groove 312 on its front edge engages with the rail 350 on the front edge of the opening 340. Thus, in the state of the transmissive window 310 being installed on the toilet lid 300, the upper face of the transmissive window 310 becomes continuous with the upper face of the toilet lid 300 so that "steps" or "seams" therebetween almost vanish. A sleek appearance is achieved, allowing smooth wipe cleaning.

In the example shown in FIGS. 12 to 16, rails 350 are provided on the sidewalls of the opening 340, and rail grooves 312 are provided on the side faces of the transmissive window 310. However, the invention is not limited thereto. For example, conversely, it is also possible to use a structure where rail grooves are provided on the sidewalls of the opening 340 and rails are provided on the side faces of the transmissive window 310.

On the other hand, at both ends on the backside of the rear of the transmissive window 310, hooks (engaging protrusions) 314 are provided. In this example, the hook 314 is formed like a claw, and is capable of vertical elastic deformation because a portion of the rail groove 312 is cut out. On the other hand, as shown in FIG. 12, at both ends of the support bridge 360 of the toilet lid 300, hooking recesses (engaging recesses) 365 are provided. When the transmissive window 310 is slid to the front edge along the rails 350, the hook 314 engages with the hooking recess 365 and is fixed. Thus the transmissive window 310 can be installed and fixed on the toilet lid 300 reliably and easily. When the transmissive window 310 installed on the toilet lid 300 is pulled rearward with a force of a prescribed level or more, the hook 314 is elastically retracted and disengaged from the hooking recess 365. Hence the transmissive window 310 can be slid rearward along the rails 350 and pulled out from the toilet lid 300. Thus, when the transmissive window 310 is broken or soiled, it can be easily removed from the toilet lid 300 and replaced, serving convenience and also improving economy.

Furthermore, by providing hooks 314 near the rear edge of the transmissive window 310 in this manner, as shown in FIG. 6, the hook 314 is scarcely seen from the user even in the opened state of the toilet lid 300. Thus the appearance can be made sleek.

In the example shown in FIGS. 12 to 16, hooks (engaging protrusions) 314 are provided on the transmissive window 310, and hooking recesses (engaging recesses) 365 are provided on the support bridge 360. However, the invention is not limited thereto. For example, conversely, it is also possible to use a structure where hooking recesses (engaging recesses) are provided on the transmissive window 310 and hooks (engaging protrusions) are provided on the support bridge 360.

On the other hand, in this example, in the closed state of the toilet lid 300, the human body detection sensor 500 detects the presence of a user through the transmissive window 310. Hence, preferably, the transmissive window 310 has a structure transmitting infrared radiation as much as possible. To this end, polyethylene, for example, is used as the material of the transmissive window 310 as described above. Furthermore, as shown in FIGS. 15 and 16, in this structure, a thin window portion 320 is provided to increase infrared transmissivity, and a thick flange portion 330 is provided therearound for support and reinforcement.

For a transmissive window 310 formed from high-density polyethylene, when the window portion 320 is thinned to a thickness of approximately 0.5 millimeters, a sufficient detection sensitivity is achieved even in the case of using a pyroelectric sensor as the human body detection sensor 500. On the other hand, if the flange portion 330 provided around the window portion 320 has a thickness of approximately 1.5 millimeters, the transmissive window 310 can be prevented from disengagement and breakage under normal conditions of use.

As described above with reference to FIG. 9, in this example, the human body detection sensor 500 is protrusively provided below the transmissive window 310. As shown in FIG. 9, the spacing S between the upper end of the case cover 430 and the transmissive window 310 is approximately 1 millimeter. Hence, while the window portion 320 is deformed upon application of pressing force on the transmissive window 310 in the closed state of the toilet lid 300, the amount of deformation is restricted up to 1 millimeter, and further pressing force is sustained by the case cover 430. Thus the transmissive window 310 can be prevented from breakage and disengagement.

The transmissive window 310 and its installation portion in this example have been described in detail.

Next, a more detailed description is given of the internal structure of the main body 400 of a toilet apparatus in which the sanitary cleansing apparatus 100 of this example is combined with a toilet bowl of the service-water direct-pressure type.

Figure 17:
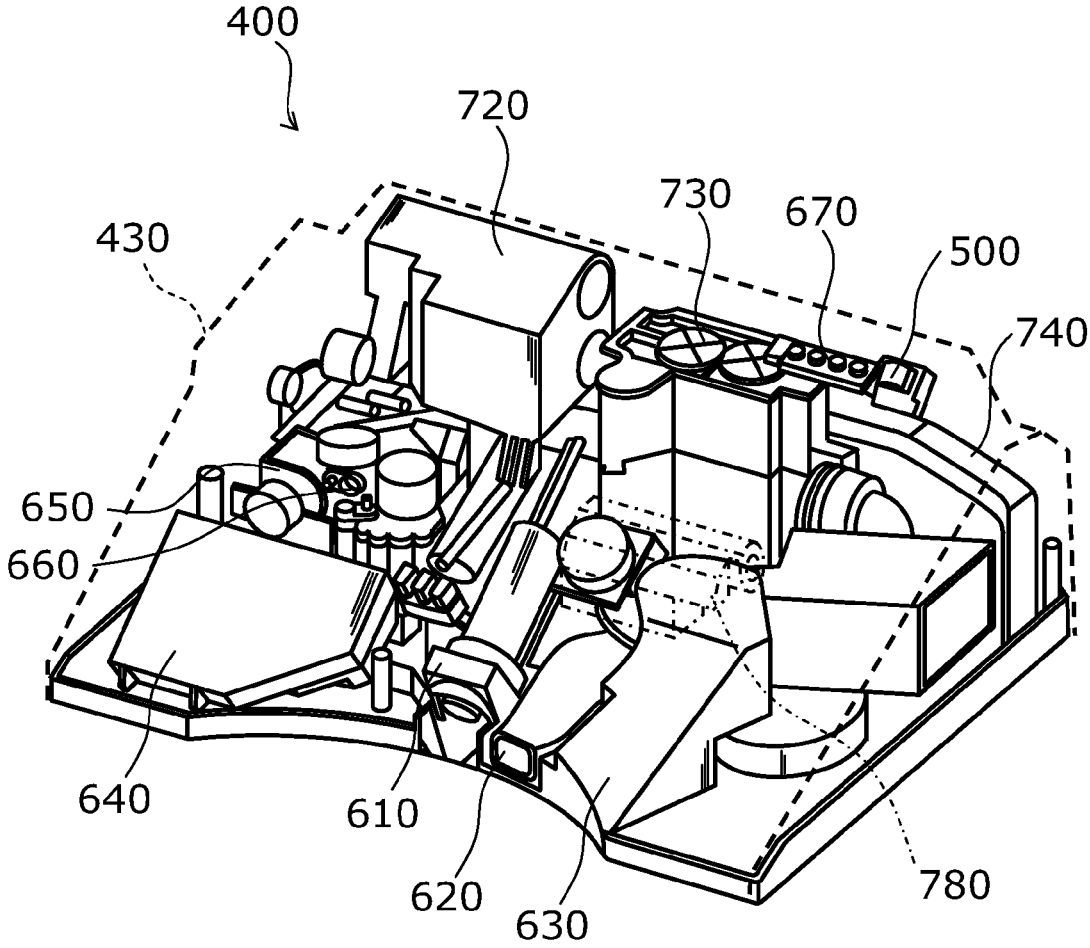
FIG. 17 is a perspective view of the inside of the main body 400 as viewed from the front.

FIG. 17 is a perspective view of the inside of the main body 400 as viewed from the front.

Figure 18:
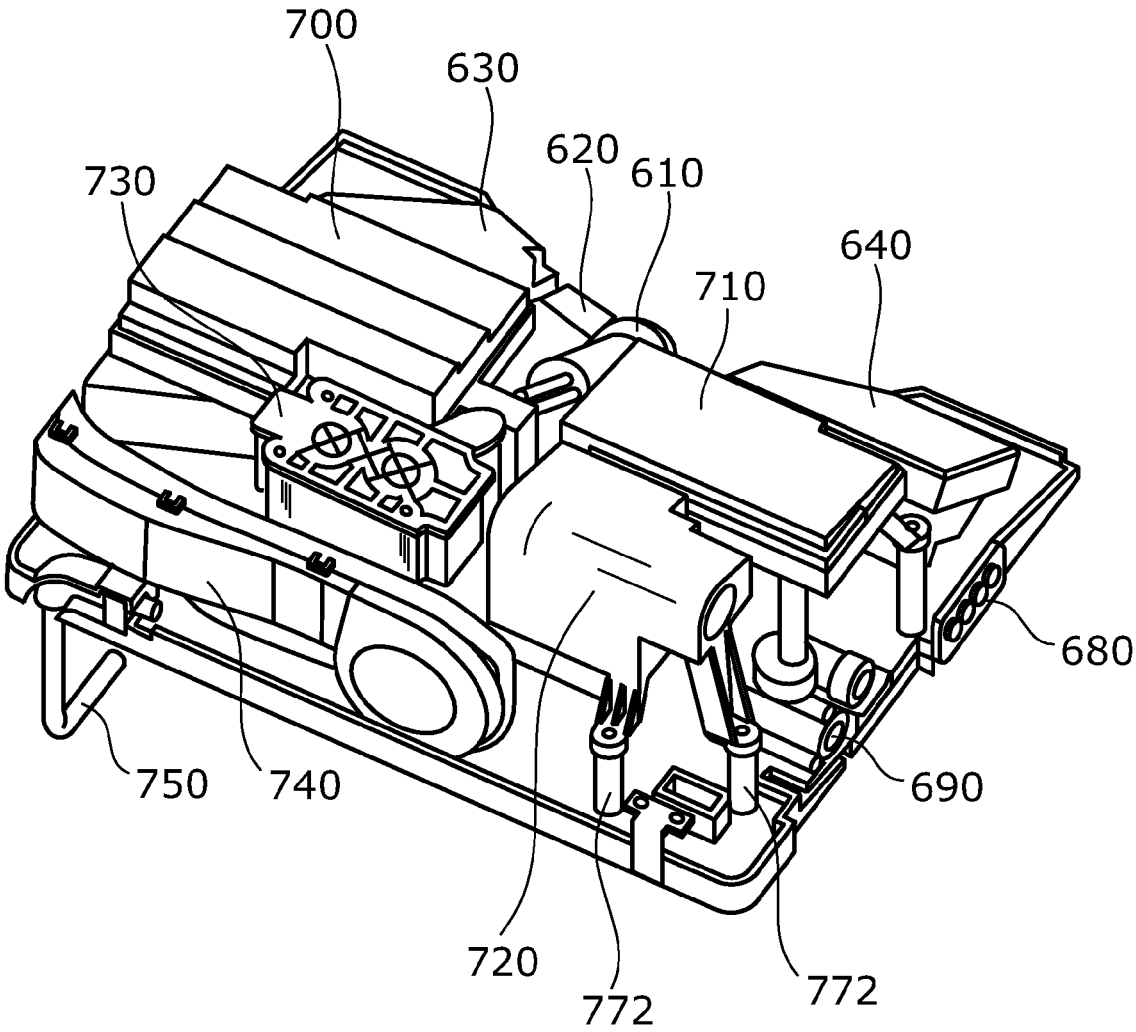
FIG. 18 is a perspective view of the inside of the main body 400 as viewed from the rear.

FIG. 18 is a perspective view of the inside of the main body 400 as viewed from the rear.

On the upper face of the case cover 430, a display portion 670 is suitably provided near the human body detection sensor 500. The display portion 670 serves to suitably display the power on/off state of the toilet apparatus, for example. Furthermore, a toilet seat opening/closing unit 780 for automatically opening/closing the toilet seat 200 is protrusively provided at the upper front of the case cover 430.

On the other hand, a nozzle unit 610, a warm air unit 620, and a deodorizing unit 630 are juxtaposed at the inner front of the case cover 430. The nozzle unit 610 includes a retractable water discharge nozzle, serving to cleanse the "bottom" of a user sitting on the toilet seat 200 by squirting water thereto. The warm air unit 620 serves to dry the "bottom" of a user sitting on the toilet seat 200 by applying warm air thereto. The deodorizing unit 630 serves to suck air in the bowl of the toilet bowl 800, to deodorize it, and to eject it from the exhaust port 440.

An AC (alternating current) controller 640 is provided at the inner front of the case cover 430, and a pump unit 650 and a heat exchange unit 660 are provided at the rear thereof. The water supplied to the heat exchange unit 660 is heated therein. The pump unit 650 imparts pulsation to the water and supplies the pulsating water to the nozzle unit 610.

An auxiliary control unit 680 is provided on the side face of the case cover 430. The auxiliary control unit 680 has a switch for operations such as cleansing the "bottom" by the nozzle unit 610, ensuring that the operation of the sanitary cleansing apparatus 100 is controllable even in the state that does not allow control by a remote controller (not shown). Furthermore, a valve unit 690 is provided at the lower rear of the case cover 430. The valve unit 690 serves to control supply of water supplied from running water to the pump unit 650.

On the other hand, a DC (direct current) controller 700 and a driver unit 710 are juxtaposed at the inner upper front of the case cover 430. A toilet lid opening/closing unit 720 and a toilet bowl washing valve unit 730 are juxtaposed at the inner rear of the case cover 430. The toilet lid opening/closing unit 720 serves to open/close the toilet lid 300. The toilet bowl washing valve unit 730 serves to control supply of wash water used for flushing the toilet bowl 800. That is, the toilet apparatus of this example has a structure of the so-called "service-water direct-pressure type", which performs washing by supplying the water supplied from running water to the toilet bowl 800 through the toilet bowl washing valve unit 730 without the intermediary of a low tank.

On the other hand, a room heating unit 740 is provided at the inner rearmost of the case cover 430. The room heating unit 740 serves to heat the toilet space equipped with the toilet apparatus by ejecting warm air from the ejection hole 450. At the lower end is placed a power cord for externally supplying power such as AC 100 V.

Figure 19:
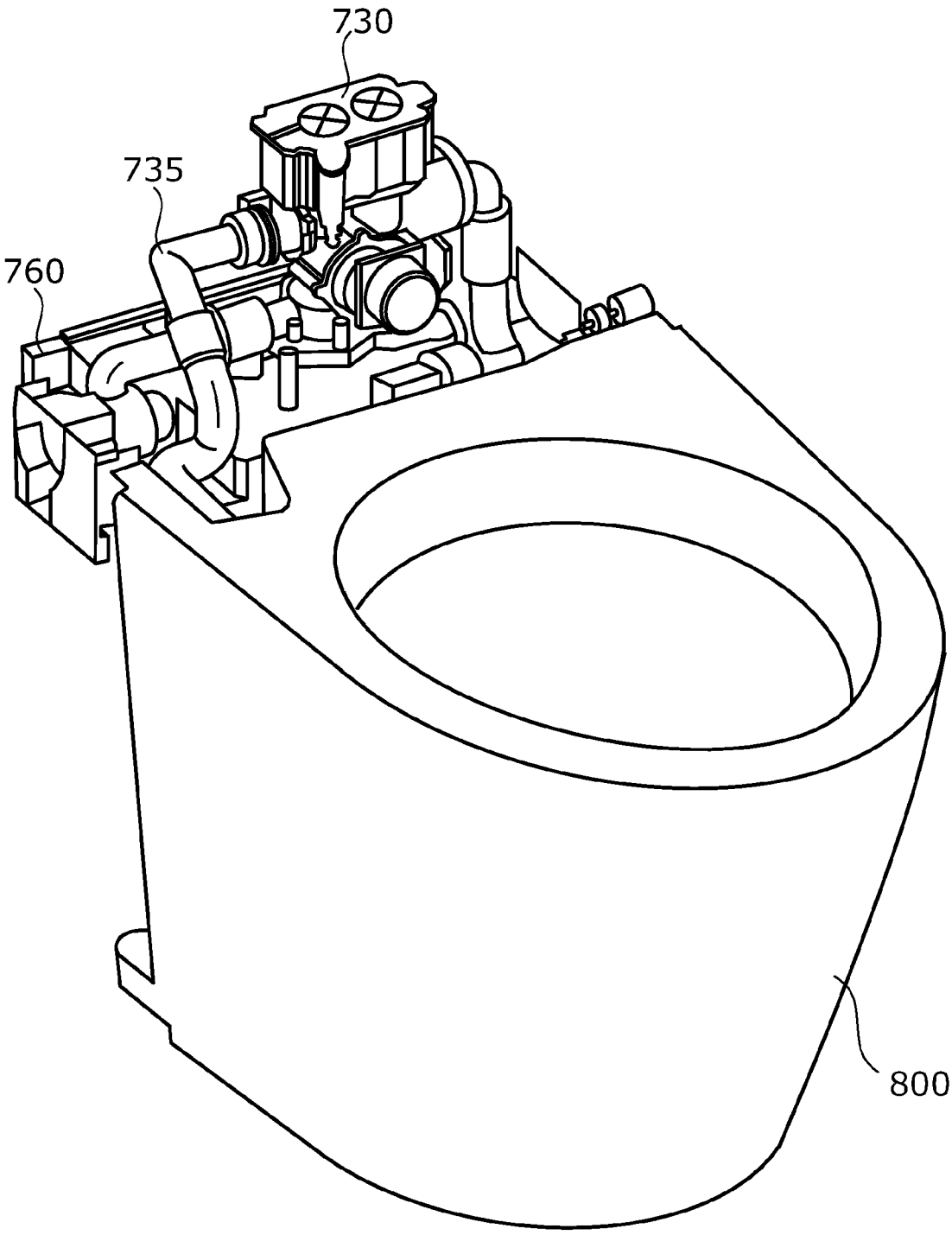
FIG. 19 is a perspective view for illustrating the installation structure of the toilet bowl washing valve unit 730.

FIG. 19 is a perspective view for illustrating the installation structure of the toilet bowl washing valve unit 730.

Figure 20:
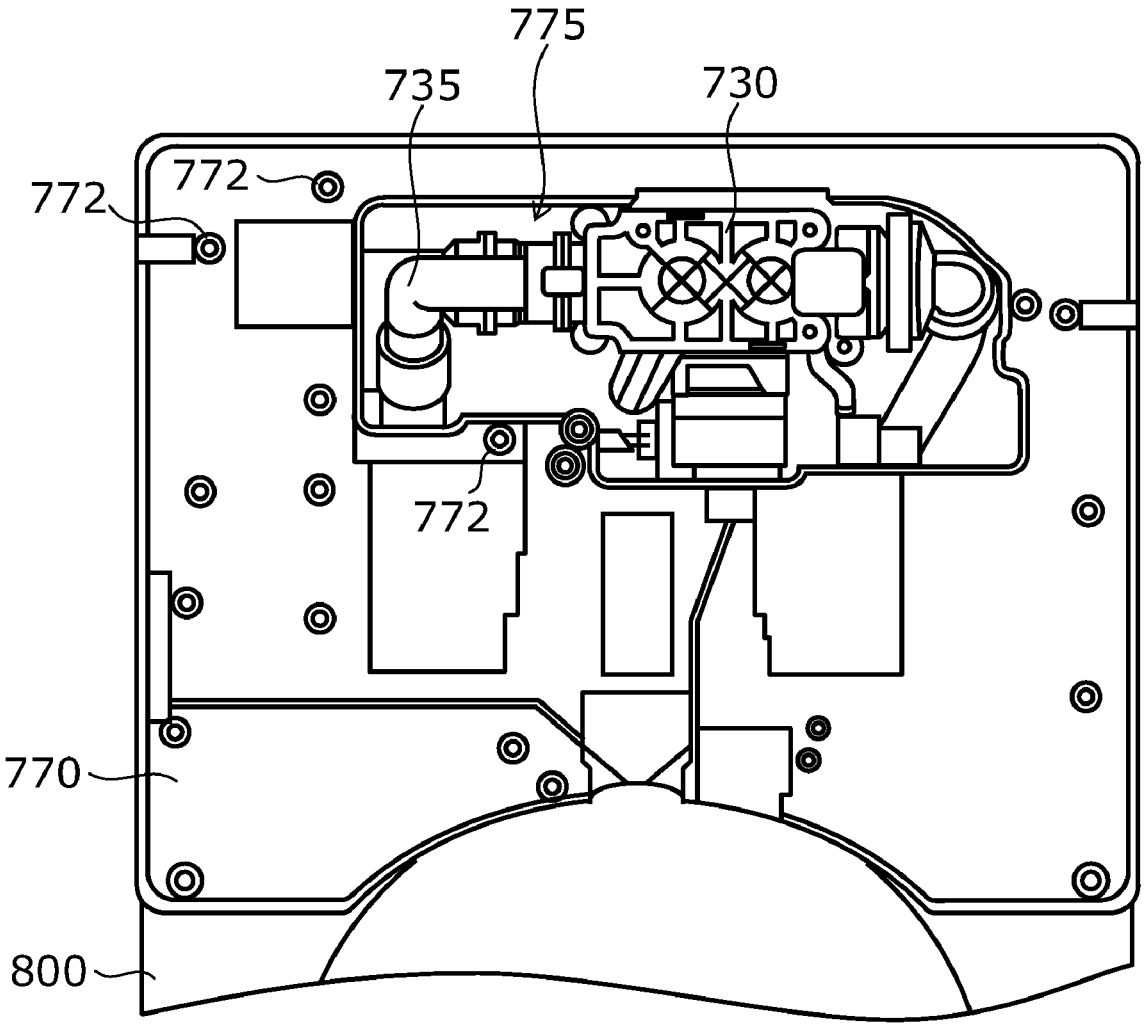
FIG. 20 is a schematic view of the installation portion of the toilet bowl washing valve unit 730 as viewed from above.

FIG. 20 is a schematic view of the installation portion of the toilet bowl washing valve unit 730 as viewed from above.

The toilet bowl washing valve unit 730 is supported by a toilet bowl side baseplate 760 fixed behind the toilet bowl 800, and is connected to the toilet bowl 800 through a feedwater piping 735. The installation board 770 of the main body 400 is fixed to the upper face of the toilet bowl 800. The toilet bowl washing valve unit 730 passes through an opening 775 provided in the installation board 770 and protrudes thereabove.

Figure 21:
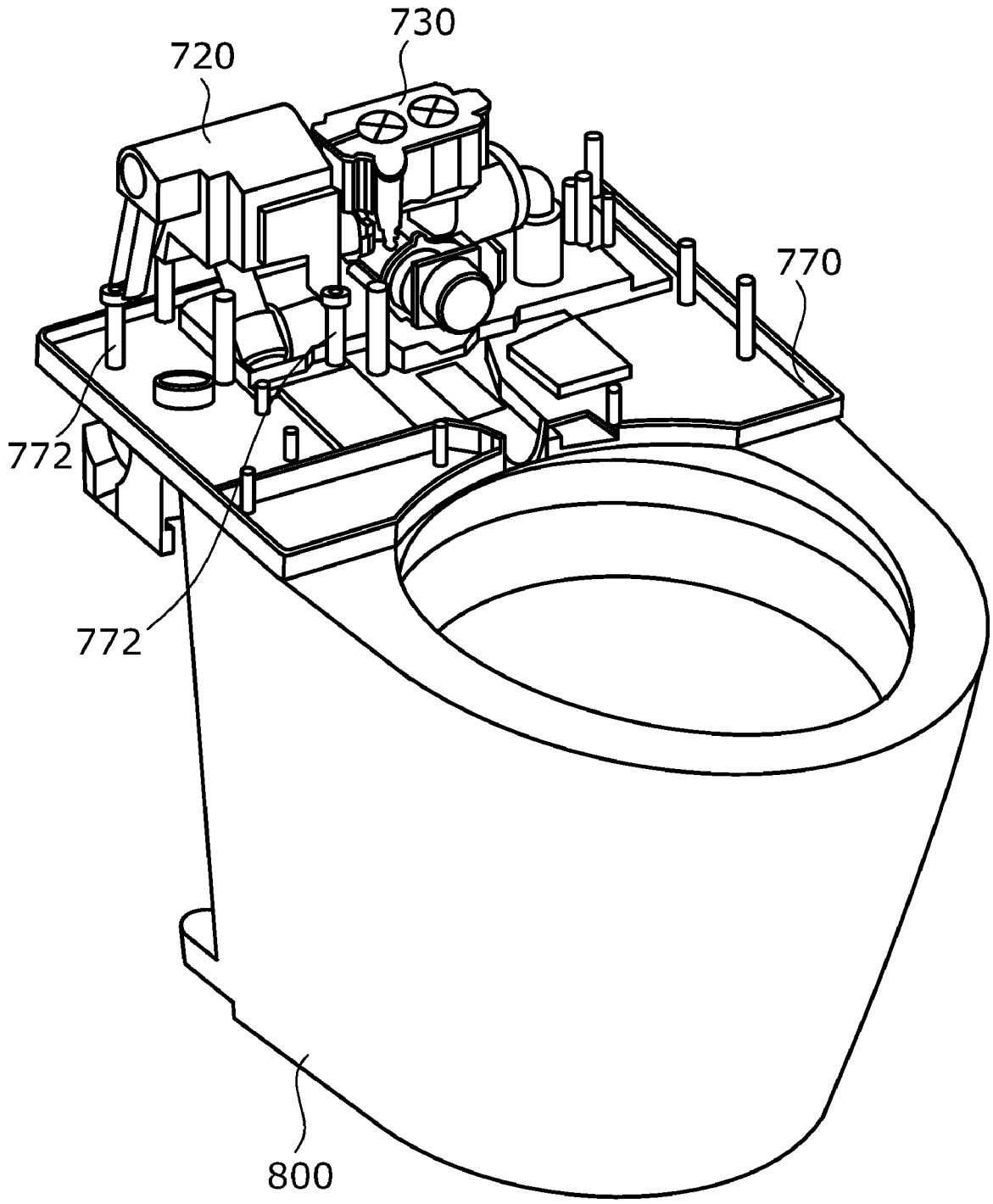
FIG. 21 is a perspective view showing the positional relationship between the toilet lid opening/closing unit 720 and the toilet bowl washing valve unit 730.

FIG. 21 is a perspective view showing the positional relationship between the toilet lid opening/closing unit 720 and the toilet bowl washing valve unit 730.

Figure 22:
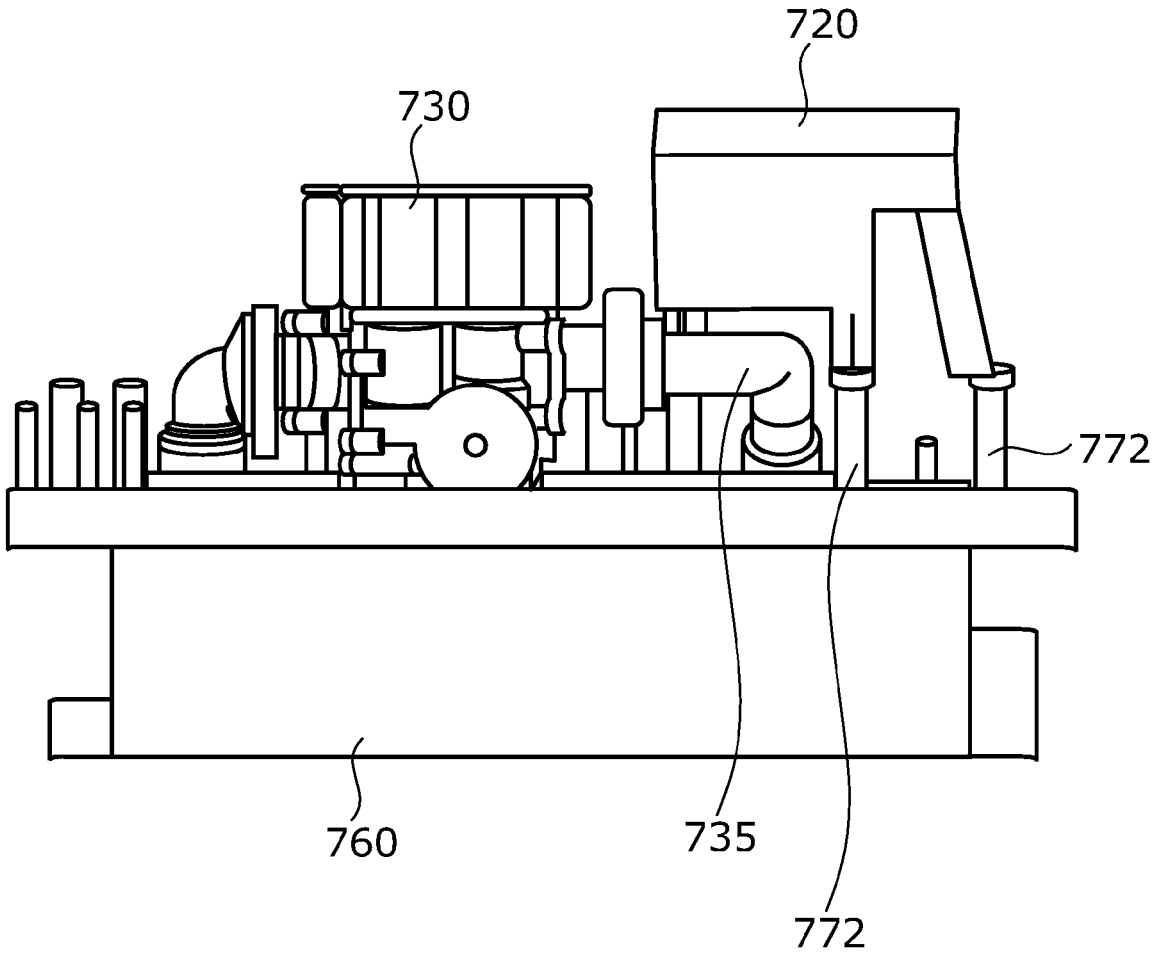
FIG. 22 is a schematic view showing the toilet lid opening/closing unit 720 and the toilet bowl washing valve unit 730 as viewed from behind

FIG. 22 is a schematic view of these elements as viewed from behind.

The toilet lid opening/closing unit 720 is screwed on a plurality of pins 772 provided upright on the installation board 770. Thus the toilet lid opening/closing unit 720 is spaced from the installation board 770, and the feedwater piping 735 is placed in that space. That is, the toilet lid opening/closing unit 720 is installed so as to straddle one pipe of the feedwater piping 735 of the toilet bowl washing valve unit 730. The toilet lid opening/closing unit 720 and the toilet bowl washing valve unit 730 are placed adjacent to each other at the rear of the main body 400. As described above with reference to FIGS. 17 and 18, the functional components of the toilet apparatus 100 such as the nozzle unit 610 are suitably placed at the front of the installation board 770 and below the toilet lid opening/closing unit 720.

As described above, the toilet apparatus of this example includes a plurality of units having various functions. According to this example, as described above with reference to FIGS. 17 and 18, the nozzle unit 610, warm air unit 620, deodorizing unit 630, pump unit 650, heat exchange unit 660, and valve unit 690 are provided below the main body 400. The toilet bowl washing valve unit 730 is internally installed at the rear of the main body 400, and the toilet lid opening/closing unit 720 is provided adjacent thereto at the rear of the main body 400. Thus, by providing the toilet lid opening/closing unit 720 at the rear of the main body 400, the toilet lid 300 can be pivotally supported at the rear of the main body 400 so as to cover generally entirely the upper face of the main body 400 when the toilet lid 300 is closed. Because the toilet lid opening/closing unit 720 is lifted above the installation board 770 by the pins 772 to accommodate therebelow the feedwater piping 735 connected to the toilet bowl washing valve unit 730, the limited space can be effectively used. Here, instead of spacing the toilet lid opening/closing unit 720 from the installation board 770 by a plurality of pins 772, the toilet bowl washing valve unit 730 may be provided with a plurality of long legs and installed on the installation board 770.

The toilet bowl washing valve unit 730 is internally installed at the rear of the main body 400, and the human body detection sensor 500 is provided thereabove. Thus the human body detection sensor 500 can be placed on the upper face of the main body 400 with the size of the main body 400 made compact, and as described above with reference to FIGS. 9 to 11, a wide range can be reliably detected through a small transmissive window 310. Here, the same advantageous effect can be achieved by providing the human body detection sensor 500 above the toilet lid opening/closing unit 720 rather than above the toilet bowl washing valve unit 730. That is, by internally installing the toilet lid opening/closing unit 720 and the toilet bowl washing valve unit 730 at the rear of the main body 400 and providing the human body detection sensor 500 above either thereof, human body detection can be reliably performed through the transmissive window 310 with the size of the main body 400 made compact.

Next, the toilet lid 300 of the toilet seat apparatus of this embodiment is described.

FIG. 23 shows schematic views of the toilet seat apparatus as viewed laterally.

Figure 23A:
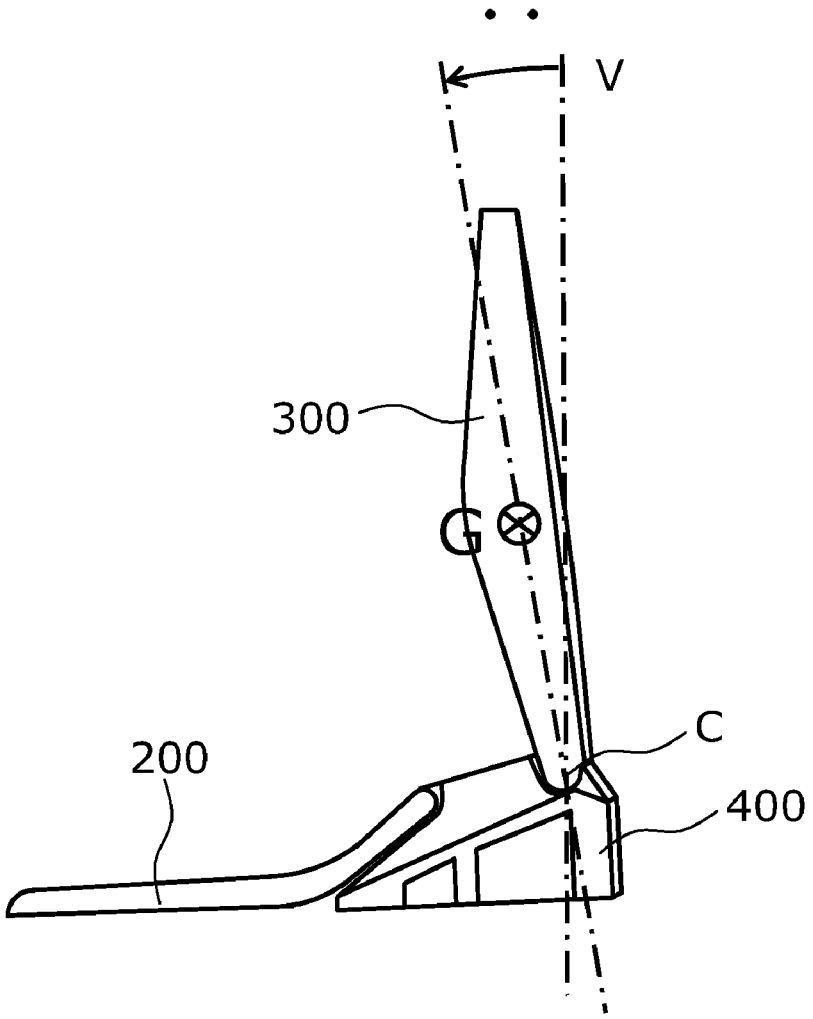
FIG. 23 shows schematic views of the toilet seat apparatus as viewed laterally.

As shown in FIG. 23A, in the completely opened state of the toilet lid 300 of the toilet seat apparatus 100 of this embodiment, the center of gravity G of the toilet lid 300 is located on the closed side of the vertically upward direction above its rotation axis C. In other words, the center of gravity G of the toilet lid 300 is located in front of the vertical line V at its rotation axis C. That is, in the toilet seat apparatus 100 of this embodiment, the toilet lid 300 remains standing with its back leaning forward when it is fully opened. Then, even if a window frame of the toilet, for example, is located behind the toilet lid 300, collision can be prevented.

It is noted that the toilet seat apparatus 100 of this example described below is similarly applicable to the toilet apparatus of the so-called "low-tank type".

As shown in FIG. 23A, in the completely opened state of the toilet lid 300, the toilet lid 300 is located on the closed side of the vertically upward direction above its rotation axis C. That is, in the toilet seat apparatus 100 of this embodiment, the toilet lid 300 remains standing with its back leaning forward when it is fully opened.

FIG. 24 shows schematic views illustrating situations where the toilet apparatus equipped with the toilet seat apparatus 100 of this example is placed in a toilet.

Figure 24A:
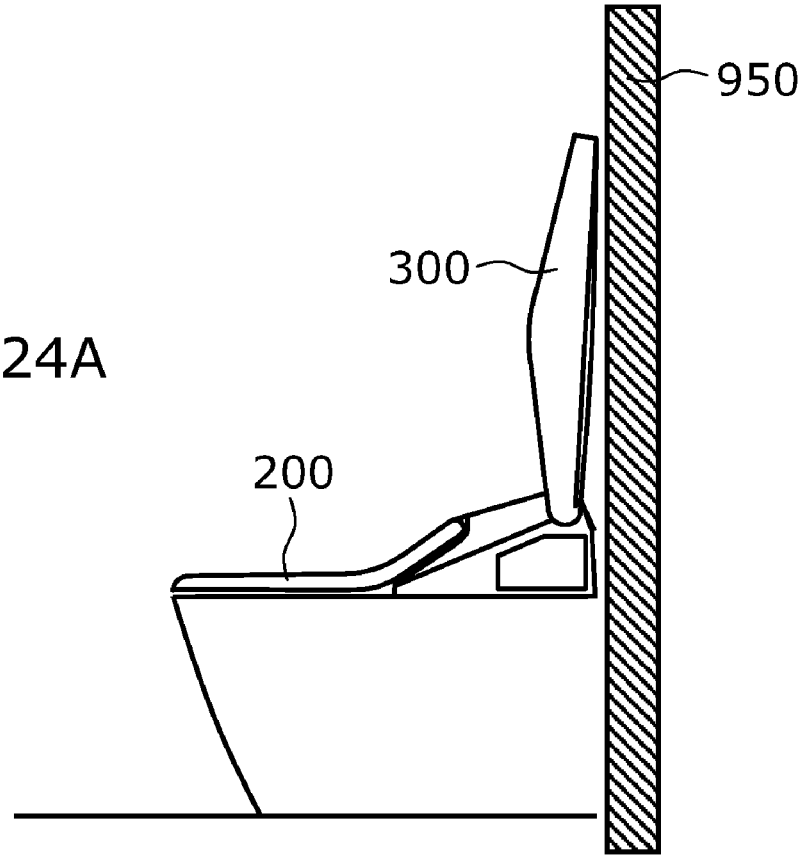
FIG. 24 shows schematic views illustrating situations where the toilet apparatus equipped with the toilet seat apparatus 100 of this example is placed in a toilet.
Figure 24B:
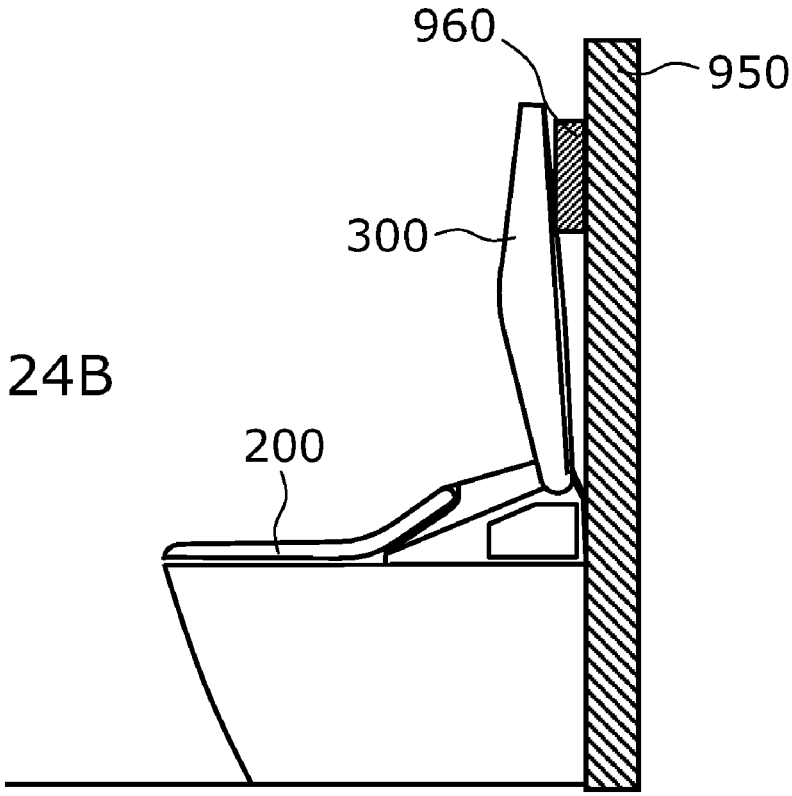

FIG. 24A shows the state of the toilet lid 300 opened to the point where the center of gravity G of the toilet lid 300 is located on the vertical line at its rotation axis C. The toilet apparatus of this example is of the so-called "service-water direct-pressure type", and hence is not provided with a low tank. Therefore the toilet apparatus can be placed next to the rear wall 950 of the toilet. Here, if the rear wall 950 of the toilet is flat, the toilet lid 300 can be opened with a slight gap left between the toilet lid 300 and the rear wall 950.

However, a protruding body 960 such as a window frame or decorative frame may be provided on the rear wall 950 of the toilet. In this case, according to this embodiment, the toilet lid 300 leans forward in the fully opened state, and thereby interference with the protruding body 960 can be prevented. That is, it is possible to eliminate annoyance due to the collision between the protruding body 960 and the toilet lid 300 occurring each time the toilet lid 300 is opened, and to also prevent the toilet lid 300 from being damaged.

The amount of protrusion, or thickness, of the window frame or decorative frame provided on the rear wall 950 of the toilet is within 20 millimeters in most cases. Hence the toilet seat apparatus 100 of this example can prevent interference with the protruding body 960 by setting the angle θ shown in FIG. 23A to approximately 7 degrees. That is, when the center of gravity G of the lid 300 leans forward by approximately 7 degrees from the state of being located on the vertical line at its rotation axis C, collisions between the protruding body 960 and the toilet lid 300 can be prevented in most cases, achieving comfortable use.

Figure 25:
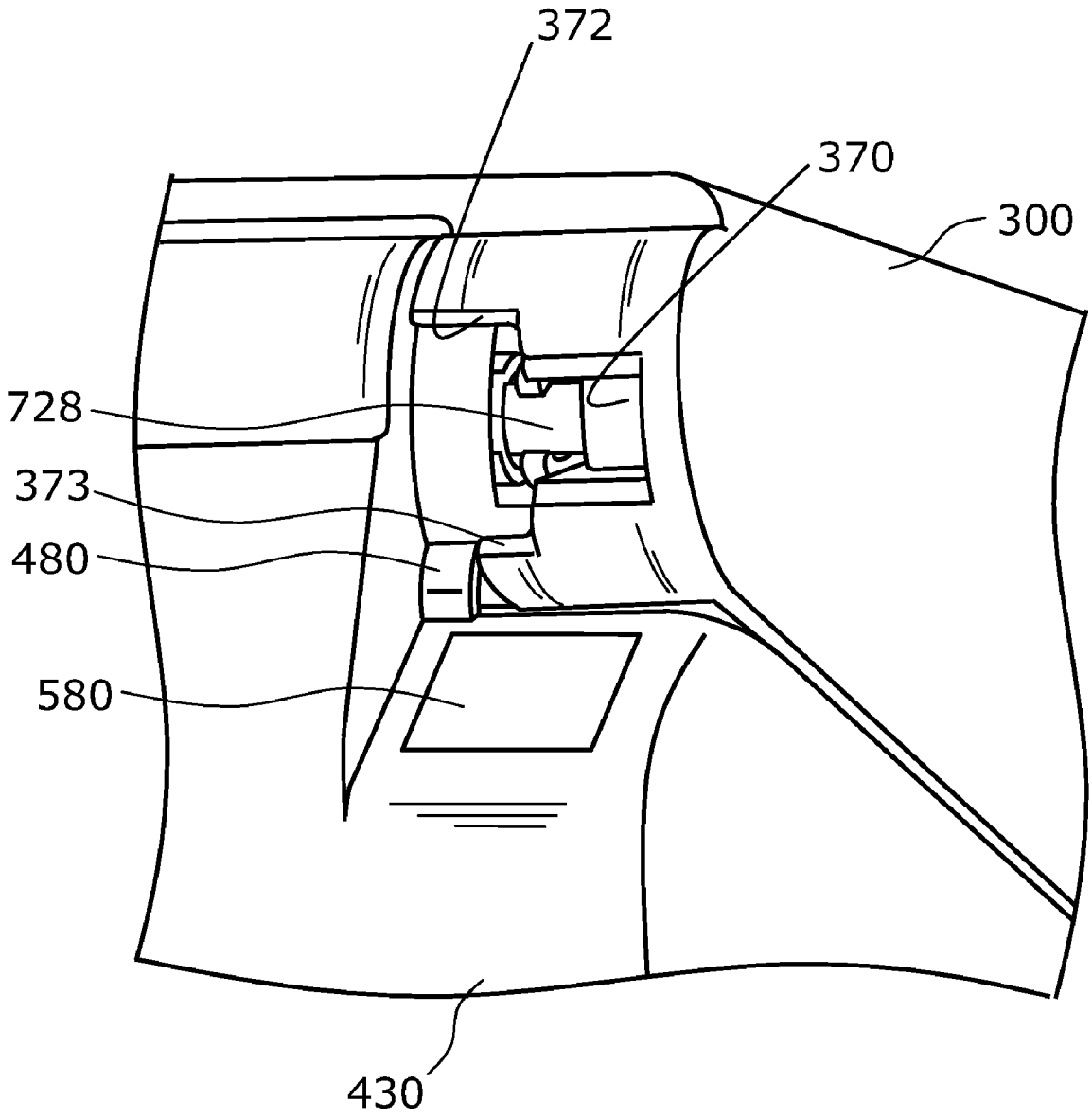
FIG. 25 is a partial enlarged schematic view showing a stopper for restricting the opening angle of the toilet lid 300.
Figure 26:
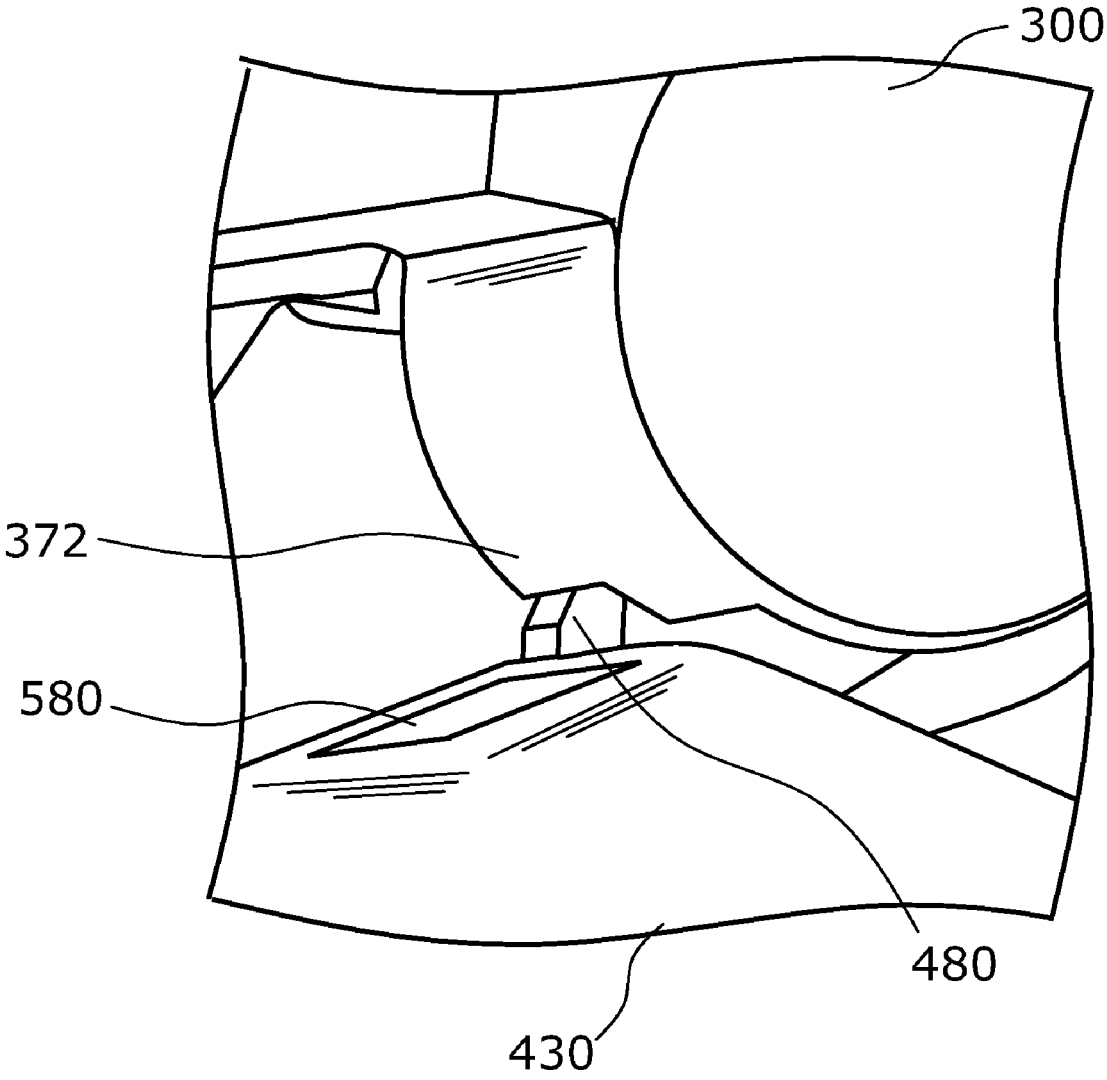
FIG. 26 is a partial enlarged schematic view showing a stopper for restricting the opening angle of the toilet lid 300.

FIGS. 25 and 26 are partial enlarged schematic views showing a stopper for restricting the opening angle of the toilet lid 300.

The rotation shaft 728 of the toilet lid 300 protrudes laterally from the main body 400. The toilet lid 300 is provided with a pivotal support 370 opening like a slit. By inserting the rotation shaft 728 into this pivotal support 370, the toilet lid 300 is rotatably and pivotally supported on the main body. On the other hand, a stopper 480 is provided at the base end of the rotation shaft 728 of the main body 400. When the toilet lid 300 is opened, as shown in FIG. 26, the opening edge 372 of the toilet lid 300 abuts the stopper 480, and the open-end angle is restricted. Thus, as shown in FIG. 23, the open-end angle of the toilet lid 300 can be reliably restricted.

As shown in FIGS. 25 and 26, a light-receiving window 580 is provided behind the rotation shaft 728 of the main body 400. This is a window portion for receiving an infrared signal transmitted from a remote controller as described later in detail.

Figure 27:
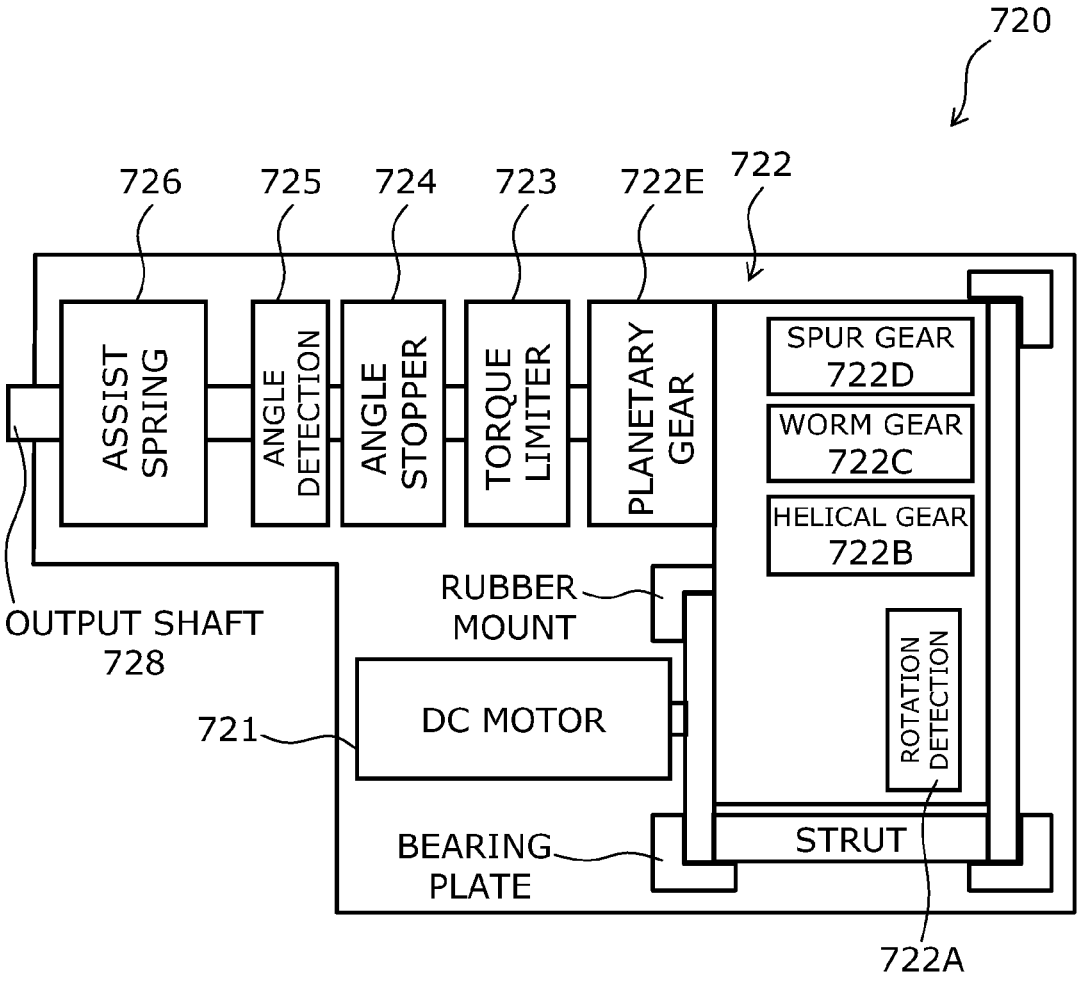
FIG. 27 is a block diagram illustrating the toilet lid opening/closing unit that can be provided for electrically rotating the toilet lid 300.

FIG. 27 is a block diagram illustrating the toilet lid opening/closing unit that can be provided for electrically rotating the toilet lid 300.

The toilet lid opening/closing unit 720 of this example can be incorporated in the main body 400, and its rotation shaft 728 can be rotated by a motor 721. Its driving mechanism includes a deceleration mechanism 722 for decelerating the rotation output of the motor 721, a torque limiter 723 for restricting the loaded maximum torque, an angle stopper 724 for restricting the rotation angle of the rotation shaft 728, an angle detector 725 for detecting the rotation angle of the rotation shaft 728, and an assist spring (elastic body) 726 for exerting a biasing force on the rotation shaft 728. The deceleration mechanism 722 includes a rotation detector 722A, a helical gear 722B, a worm gear 722C, a spur gear 722D, and a planetary gear 722E.

By using this toilet lid opening/closing unit 720, the toilet lid 300 can be electrically opened/closed. Even in the state where this toilet lid opening/closing unit 720 is installed, the toilet lid 300 can be manually opened/closed. Whether electrically or manually, the assist spring 726 allows the toilet lid 300 to be lightly opened, and to reliably maintain the forward-leaning state when it is completely opened as described above with reference to FIG. 23.

Figure 28:
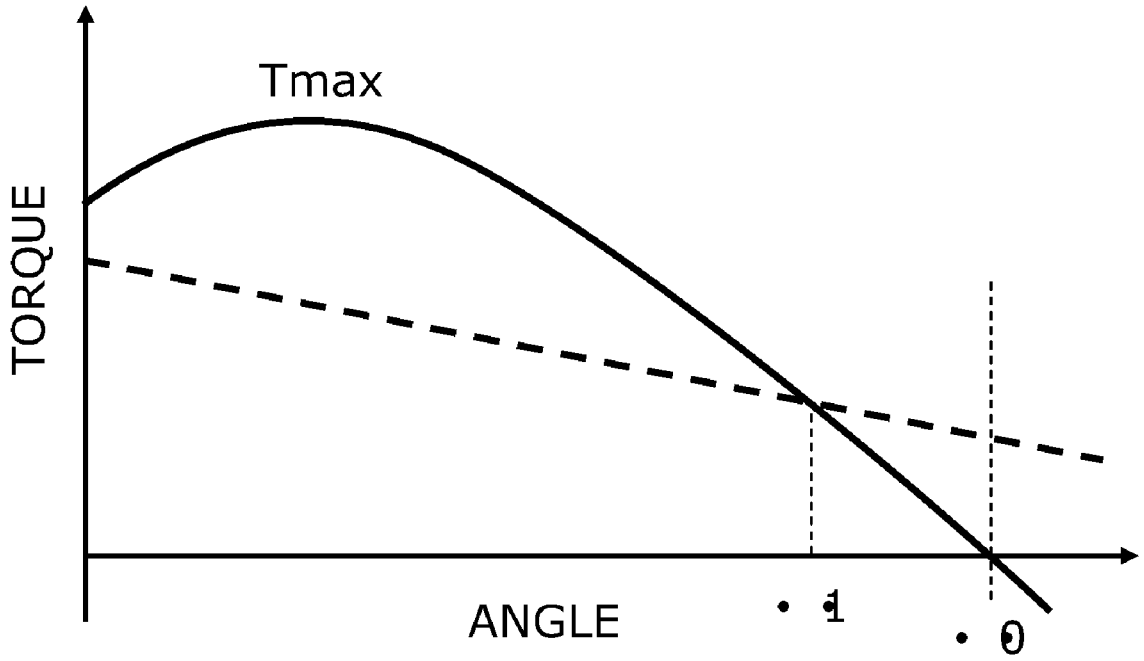
FIG. 28 is a graph illustrating the relationship between the opening angle of the toilet lid 300 and the torque loaded on the rotation shaft 728 by the weight of the toilet lid 300.

FIG. 28 is a graph illustrating the relationship between the opening angle of the toilet lid 300 and the torque loaded on the rotation shaft 728 by the weight of the toilet lid 300.

Figure 23B:
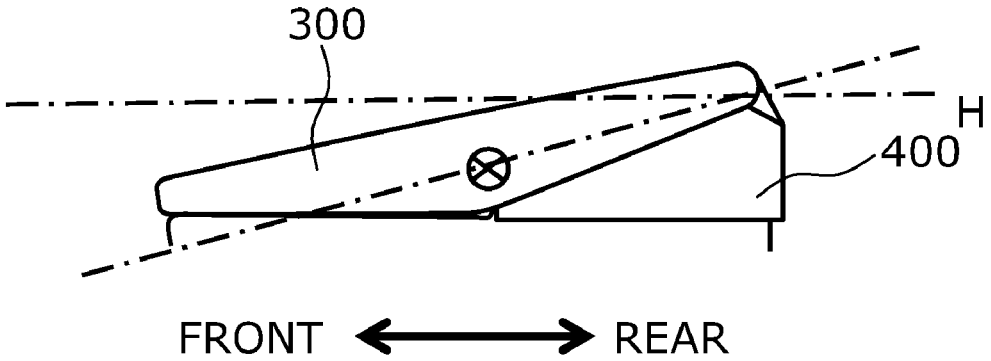

As shown in FIG. 23B, in the case of the toilet seat apparatus 100 of this example, in the closed state of the toilet lid 300, its center of gravity G is located vertically below the horizontal line H at the rotation axis C. Hence, in the course of opening the toilet lid 300 from this state, when the center of gravity G comes on the horizontal line H, the torque at the rotation shaft 728 by the weight moment of the toilet lid 300 takes on the maximum Tmax. When the toilet lid 300 is further opened, the torque by the weight moment gradually decreases. If the assist spring 726 is not provided, the torque vanishes when the center of gravity G comes vertically above the rotation shaft 728 (θ0), or on the vertical line V (FIG. 23). That is, at this angle θ0, the toilet lid 300 can maintain standing. In this embodiment, the open-end angle of the toilet lid 300 is smaller than this standing angle θ0. That is, as described above with reference to FIGS. 25 and 26, the open-end angle is restricted to less than θ0 by the stopper 480.

In this embodiment, the assist spring 726 biases the rotation shaft 728 to the direction of opening the toilet lid 300. The assist spring 726 produces a torque gradually decreasing with respect to the opening angle of the toilet lid 300 as shown in FIG. 28. By providing such an assist spring 726, the torque by the weight moment of the toilet lid 300 is alleviated. That is, the remainder of the torque of the assist spring 726 subtracted from the torque by the weight moment of the toilet lid 300 is the torque required for opening/closing the toilet lid 300. Hence, at angle θ1 where these are balanced, the toilet lid 300 can maintain standing. When the toilet lid 300 is opened more than θ1, a torque in the opening direction is loaded on the rotation shaft 728. That is, when the toilet lid 300 is opened more than θ1, the toilet lid 300 is then automatically opened to the open-end angle. In this embodiment, the maximum opening angle of the toilet lid 300 shown in FIG. 23A is set to an angle larger than this angle θ1. That is, in the state of the toilet lid 300 being stopped by the stopper 480 (FIGS. 25 and 26), the torque by the biasing force of the assist spring 726 is larger than the torque by the weight moment of the toilet lid 300. Then, in the fully opened state, the toilet lid 300 is biased toward the stopper 480 by the assist spring 726, and can maintain the forward-leaning posture without falling forward.

In the example shown in FIG. 27, an assist spring 726 is incorporated in the electrically-driven toilet lid opening/closing unit 720. However, the invention is not limited thereto. More specifically, the assist spring 726 may be provided outside the toilet lid opening/closing unit 720. Alternatively, even if the toilet lid opening/closing unit 720 is not provided and the toilet lid is opened/closed only by manual operation, the forward-leaning posture as shown in FIG. 23A can be retained by providing a similar assist spring to bias the toilet lid 300 in the opening direction.

The toilet lid opening/closing unit 720 shown in FIG. 27 can detect the position and operating state of the toilet lid 300 by using the rotation detector 722A provided in its deceleration mechanism 722 and the angle detector 725 for detecting the angle of the rotation shaft 728. On the basis of detection information thereof, the controller 640 (FIG. 17) incorporated in the main body 400 can learn the open-end angle of the toilet lid 300. For example, if the toilet lid 300, upon being opened, reaches the open-end angle, the motor 721 stops rotation, which is detected by the rotation detector 722A of the deceleration mechanism 722. Furthermore, the opening angle of the toilet lid 300 can be learned by the angle detector 725. Hence, when the toilet lid 300 is opened the next time, the toilet lid 300 can be controlled so that the toilet lid 300 decreases its speed with approaching the opening angle and slowly reaches the open-end angle.

Then, for example, when the toilet apparatus of this example is placed in a toilet having a protruding body 960 with a large amount of protrusion described above with reference to FIG. 24B and is operated for the first time, the opening angle of the toilet lid 300 can be learned. From the next operation forward, the toilet lid 300 can be prevented from slamming on the protruding body 960. Likewise, also in the case of additionally placing a decorative frame having a large amount of protrusion on the rear wall of the toilet after placing the toilet apparatus of this example and starting its use, the toilet seat apparatus 100 newly learns the opening angle of the toilet lid 300, and can control the opening operation of the toilet lid 300 so as to avoid its slamming thereon from the next operation forward.

FIG. 29 is a schematic view illustrating the operation of the toilet apparatus of this example in the case of simultaneously opening the toilet seat 200 and the toilet lid 300.

Figure 29A:
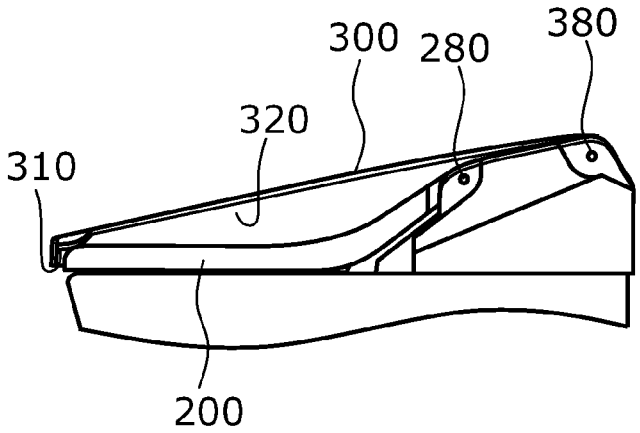
FIG. 29 is a schematic view illustrating the operation of the toilet apparatus of this example in the case of simultaneously opening the toilet seat 200 and the toilet lid 300.
Figure 29B:
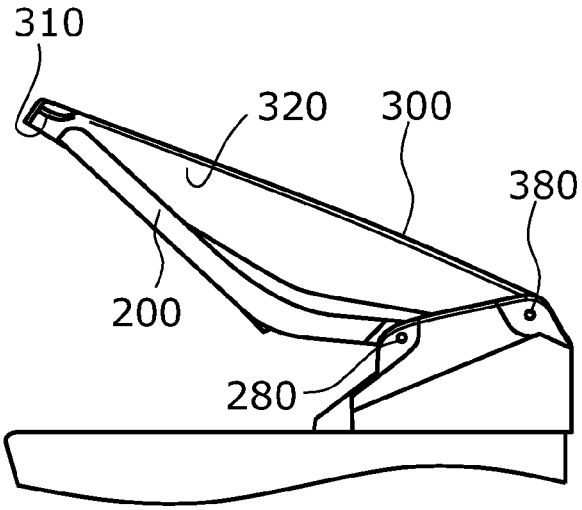
Figure 29C:
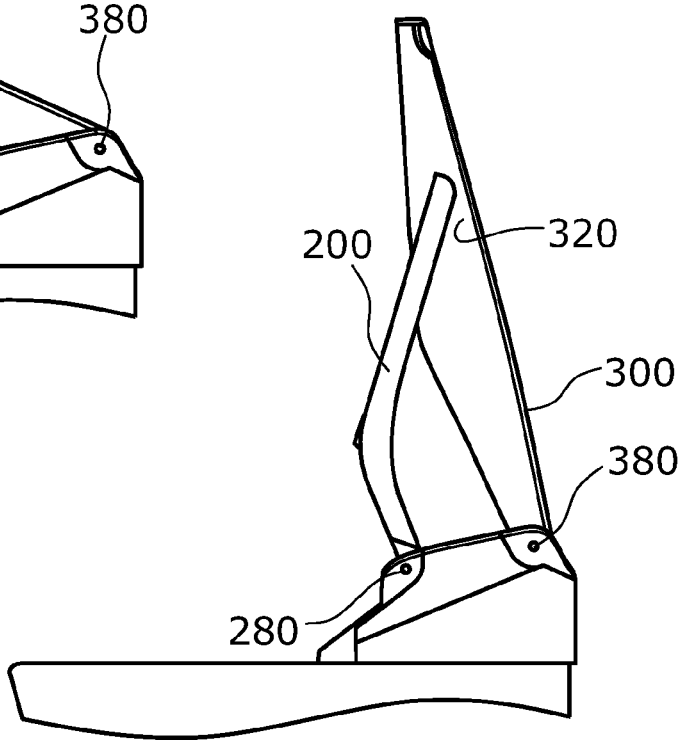

When the toilet seat 200 is manually opened from the state of the toilet seat 200 and the toilet lid 300 being closed as shown in FIG. 29A, the toilet lid 300 is pushed by the toilet seat 200 and simultaneously opened as shown in FIG. 29B. Then, as shown in FIG. 29C, when the toilet seat 200 is completely opened, the toilet lid 300 is in a state of leaning forward approximately 10 degrees relative to the fully opened state shown in FIG. 23. However, even in this case, the biasing force of the assist spring 726 described above with reference to FIGS. 27 and 28 allows the toilet lid 300 to maintain the opened state without being closed.

In addition, in the case of providing the toilet lid opening/closing unit 720 described above with reference to FIG. 27, its angle detector 725 can be used to detect that the toilet lid 300 has been opened to the angle shown in FIG. 29C, and then the motor 721 can be controllably driven to automatically open the toilet lid 300 to the open-end angle.

Next, a description is given of other effects achieved by restricting the open-end angle of the toilet lid 300 in this embodiment.

By maintaining the toilet lid 300 in the forward-leaning posture, advantageously, infrared radiation transmitted from a remote controller can be reliably received.

Figure 30:
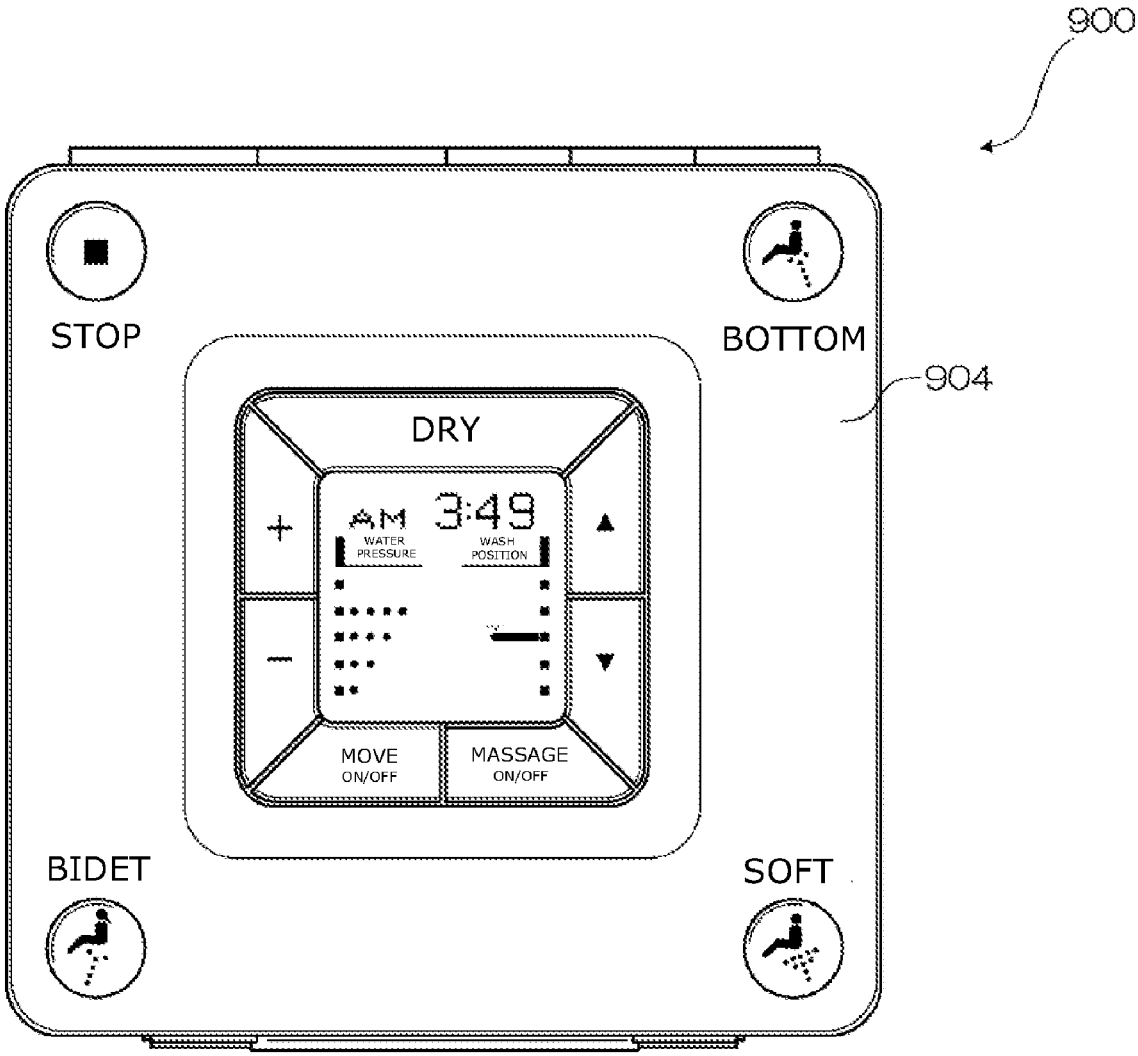
FIG. 30 is a schematic view showing a remote controller that can control the toilet seat apparatus 100 of this example.
Figure 31:
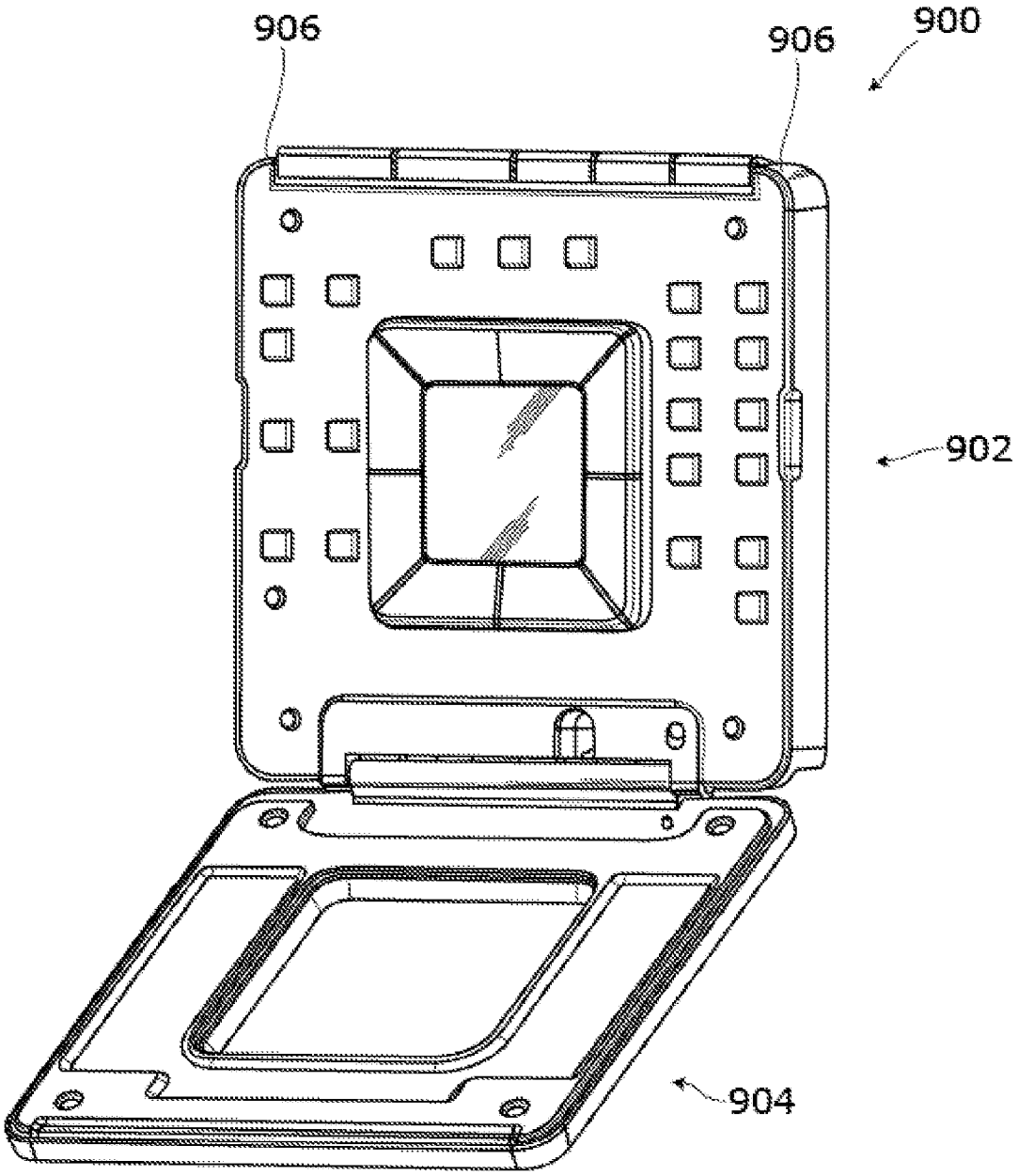
FIG. 31 is schematic view showing a remote controller that can control the toilet seat apparatus 100 of this example.

FIGS. 30 and 31 are schematic views showing a remote controller that can control the toilet seat apparatus 100 of this example.

The remote controller 900 of this example includes a main body 902 and a cover 904 reclosably hinged thereto. FIG. 30 shows the state of the cover 904 being closed, and FIG. 31 shows the state of the cover 904 being opened.

The main body 902 and the cover 904 are each provided with switches. A user can manipulate these switches to control the operation of the toilet seat apparatus 100. The command signal to the main body 400 of the toilet seat apparatus 100 is transmitted from an infrared emitter 906 provided on both ends at the top of the remote controller.

Figure 32:
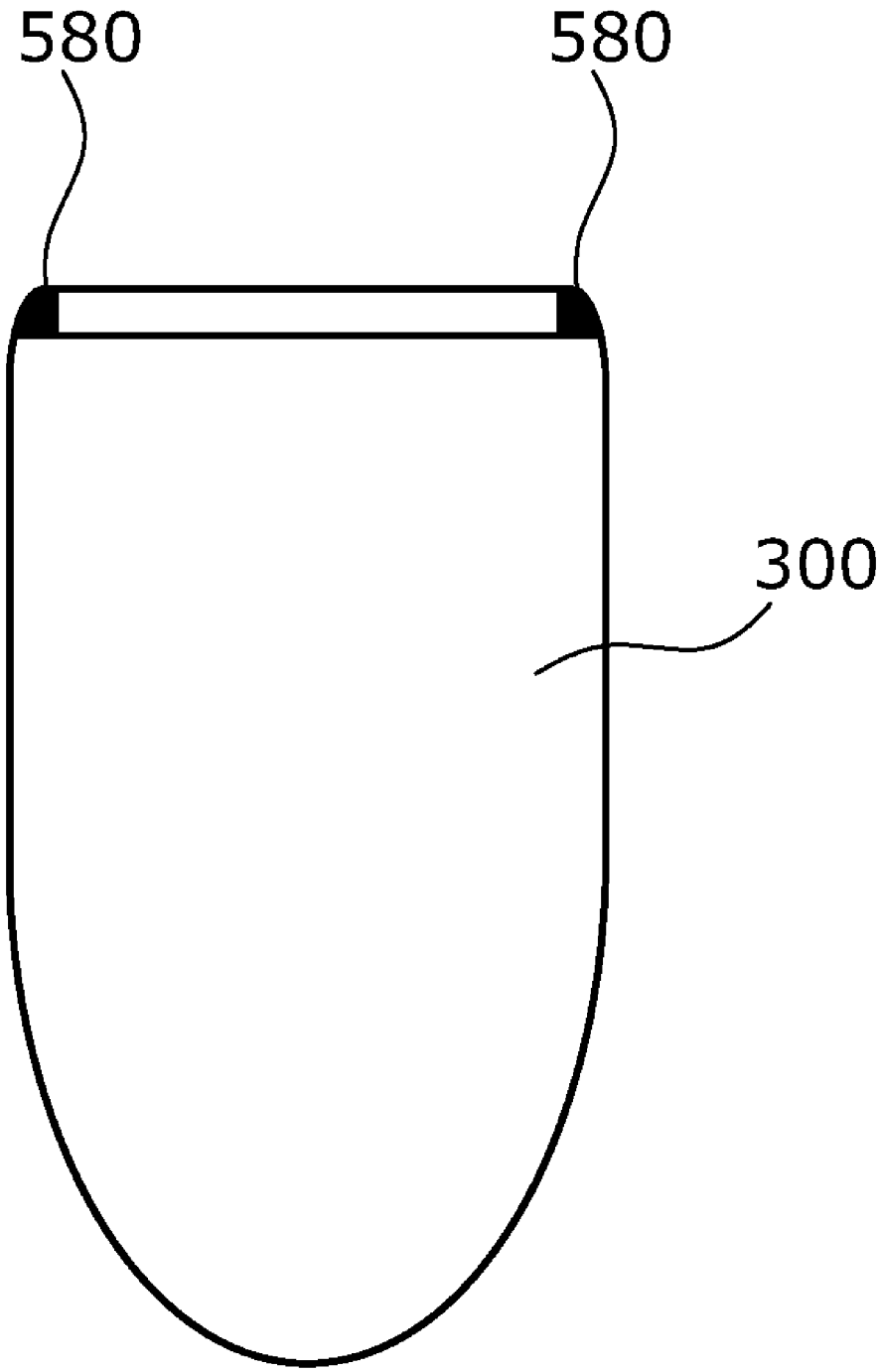
FIG. 32 is a schematic views showing the position of the light-receiving window 580 provided on the main body 400.
Figure 33:
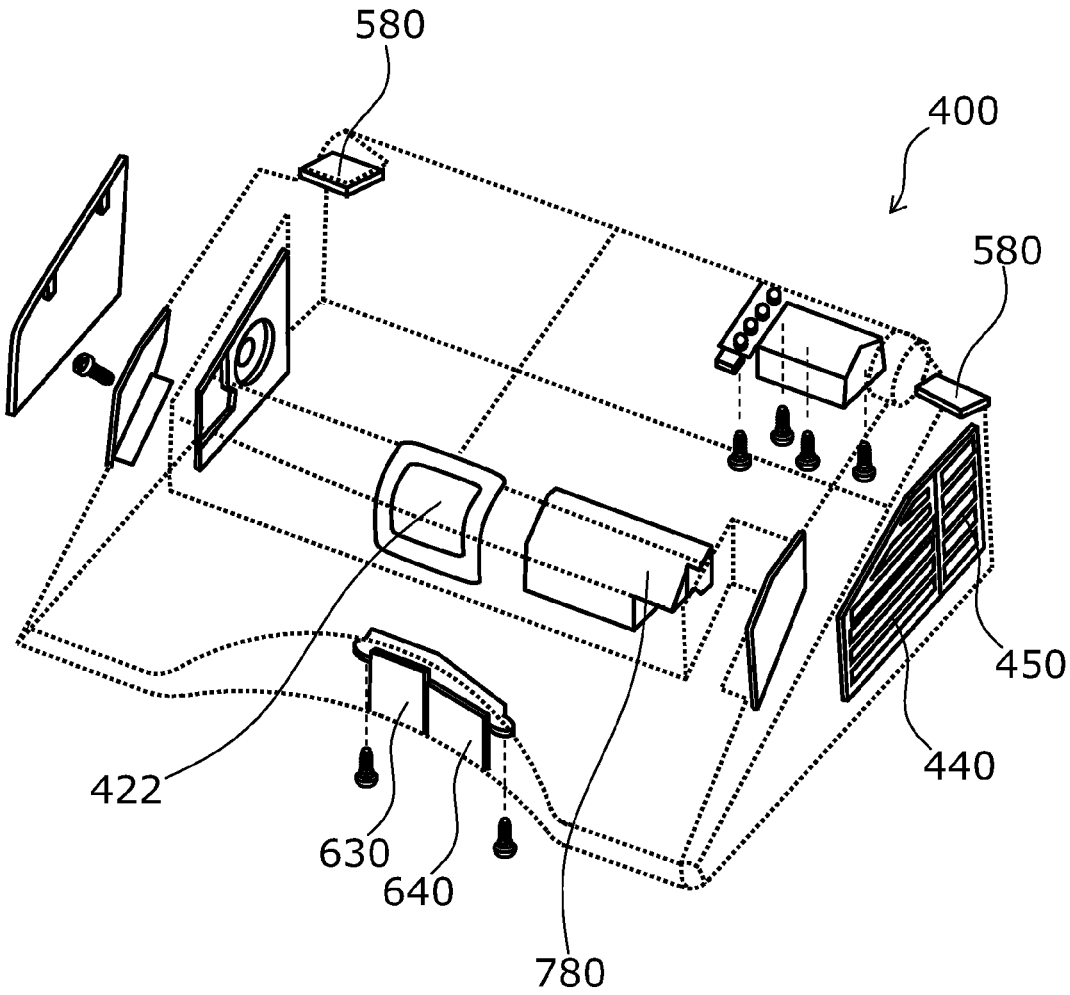
FIG. 33 is a schematic views showing the position of the light-receiving window 580 provided on the main body 400.

FIGS. 32 and 33 are schematic views showing the position of the light-receiving window 580 provided on the main body 400. More specifically, FIG. 32 is a schematic view of the toilet lid 300 of the toilet seat apparatus 100 of this example in the closed state as viewed from above. FIG. 33 is a perspective view of the main body 400.

As described above with reference to FIGS. 1 and 2, the toilet seat apparatus 100 of this example has a structure where it is nearly entirely covered with the toilet lid 300 in the closed state of the toilet lid 300. As described above, this achieves a sleek appearance and facilitates cleaning. However, even in the closed state of the toilet lid 300, infrared radiation from the remote controller 900 needs to be received. Hence, as shown in FIGS. 25, 26, 32, and 33, in this example, a downward step is provided behind the pivotal support of the toilet lid 300, and a light-receiving window 580 is provided at the step. In the case of providing a light-receiving window 580 at this position, the light-receiving window 580 is scarcely seen from a user standing in front of the toilet bowl 800 even in the closed state of the toilet lid 300, doing no harm to the sleek appearance.

According to this embodiment, by maintaining the toilet lid 300 in the forward-leaning posture at the open-end angle, infrared radiation transmitted from the remote controller can be reliably received.

Figure 34:
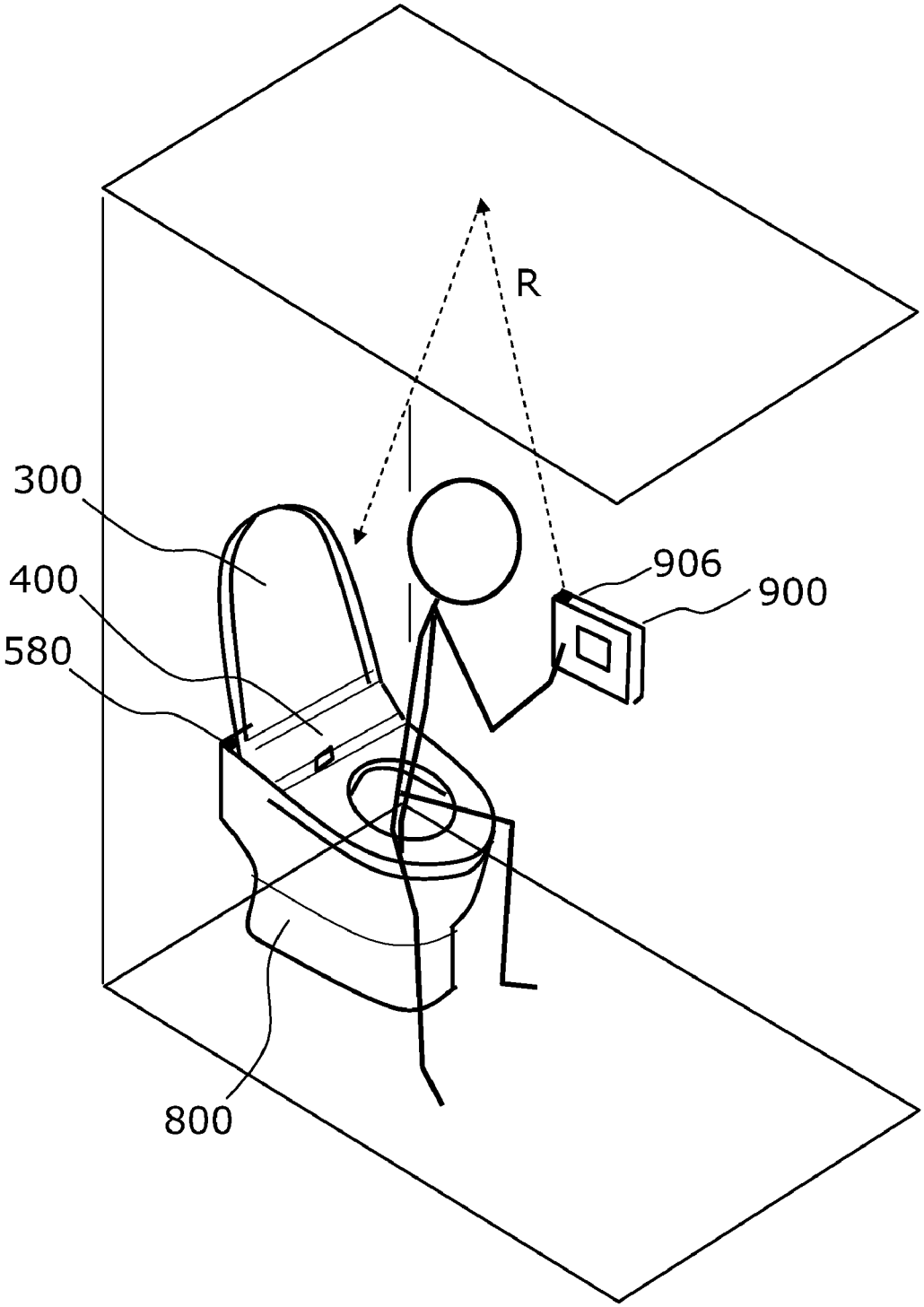
FIG. 34 is a schematic view illustrating the path of infrared radiation transmitted from the remote controller 900.

FIG. 34 is a schematic view illustrating the path of infrared radiation transmitted from the remote controller 900.

As shown by arrow R, infrared radiation R is emitted upward from the infrared emitter 906 provided in the remote controller 900. The emitted infrared radiation is reflected by the ceiling of the toilet and directed to the main body 400. However, if the opening angle of the toilet lid 300 is large, the infrared radiation reflected by the ceiling may be blocked by the toilet lid 300 and difficult to reach the light-receiving window 580 of the main body 400.

FIG. 35 is a schematic view for illustrating the path of infrared radiation.

Figure 35A:
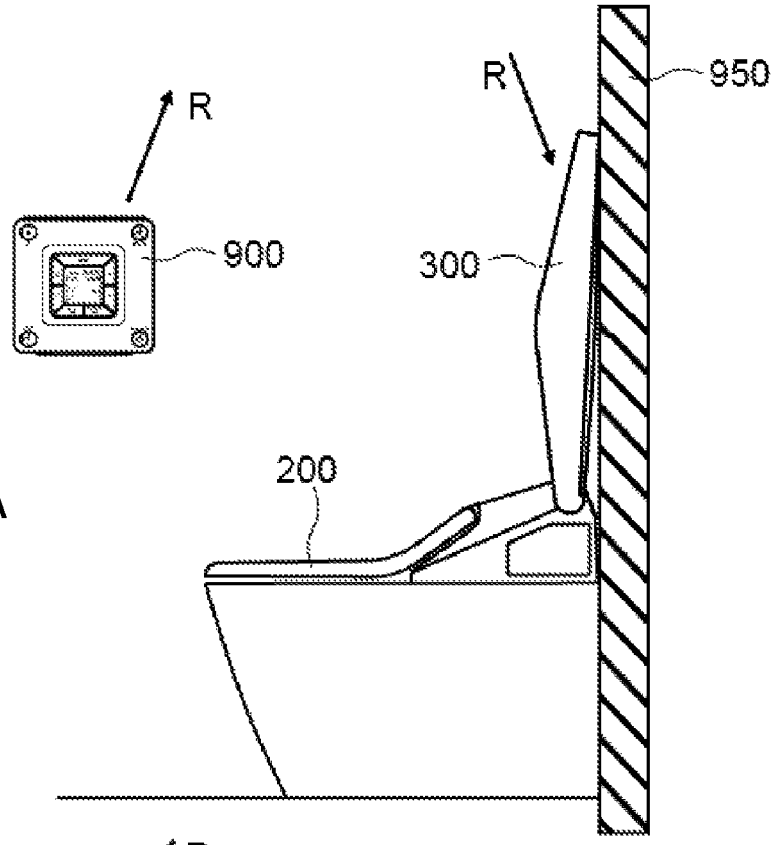
FIG. 35 is a schematic view for illustrating the path of infrared radiation.

As shown in FIG. 35A, if the opening angle of the toilet lid 300 is large, the infrared radiation R reflected by the ceiling of the toilet is likely to be blocked by the toilet lid 300. In particular, in the case where the toilet apparatus is placed next to the rear wall 950 of the toilet, little gap remains between the toilet lid 300 and the rear wall 950 of the toilet when the opening angle of the toilet lid 300 is large. Hence the infrared radiation R reflected by the ceiling cannot enter behind the toilet lid 300 and is difficult to reach the light-receiving window 580.

Figure 35B:
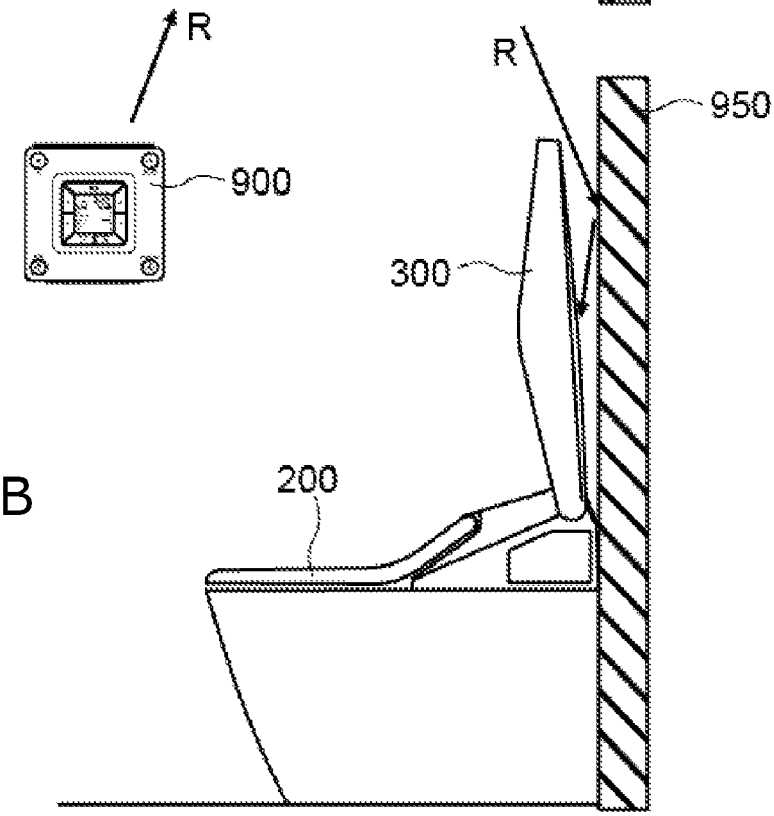

In contrast, as shown in FIG. 35B, if the opening angle of the toilet lid 300 is restricted to force the forward-leaning posture, the toilet lid 300 is spaced from the rear wall 950 and a sufficient gap occurs even in the case where the toilet apparatus is placed next to the rear wall 950. Consequently, the infrared radiation R reflected by the ceiling can enter behind the toilet lid 300 and reach the light-receiving window 580 directly or with suitably repeating reflection between the toilet lid 300 and the rear wall 950.

As described above, according to this embodiment, while the toilet lid 300 nearly entirely covers the toilet seat apparatus 100, the infrared signal transmitted from the remote controller 900 can be reliably received to ensure operation even in the opened state of the toilet lid 300.

Next, a description is given of a variation where the toilet seat apparatus 100 is provided with a lamp.

Figure 36:
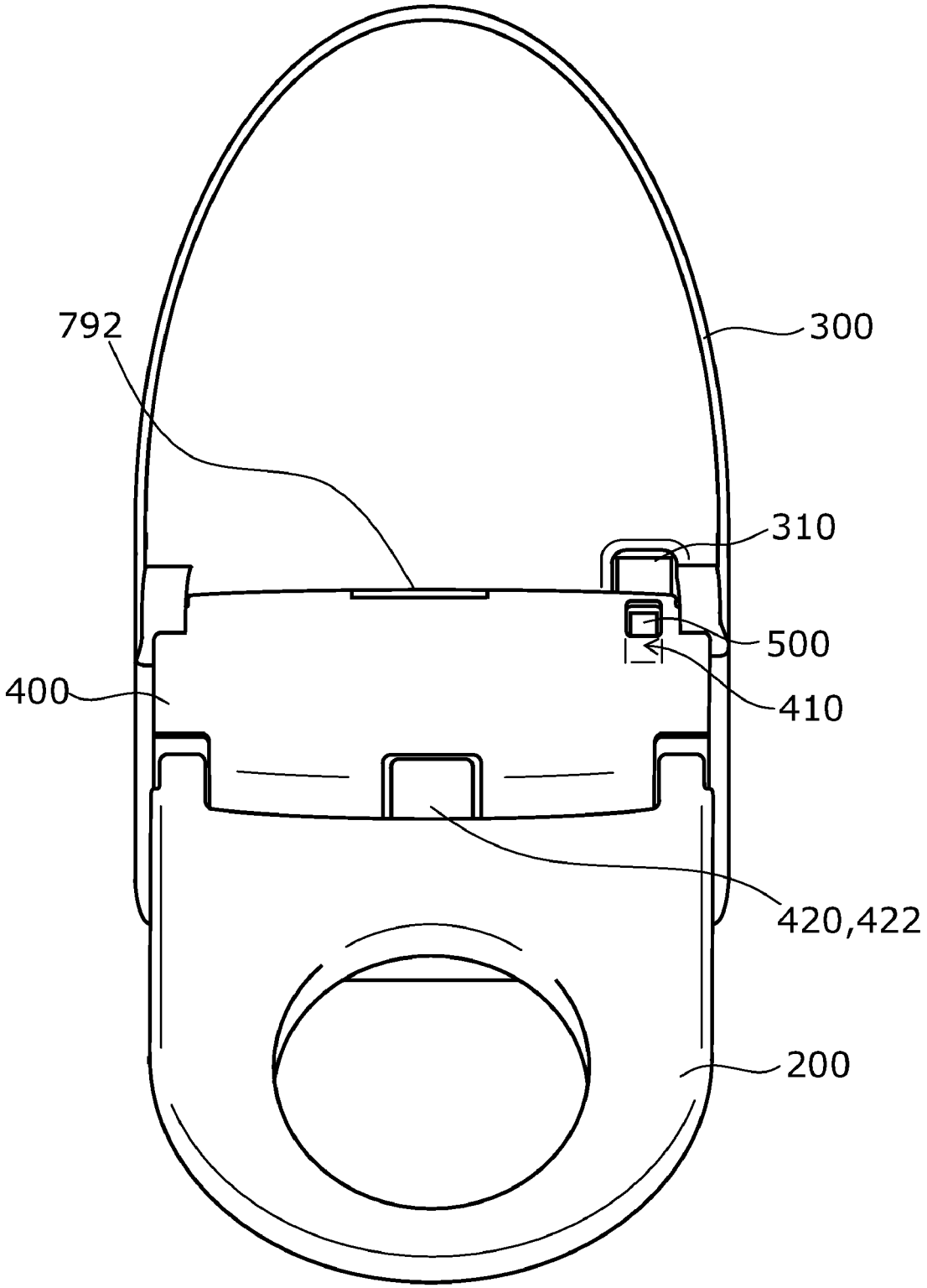
FIG. 36 is a schematic view showing the toilet seat apparatus 100 of this variation in the opened state of the toilet lid 300.

FIG. 36 is a schematic view showing the toilet seat apparatus 100 of this variation in the opened state of the toilet lid 300.

The toilet seat apparatus 100 of this variation includes a lamp 792 at the upper rear of the main body 400.

Figure 37A:
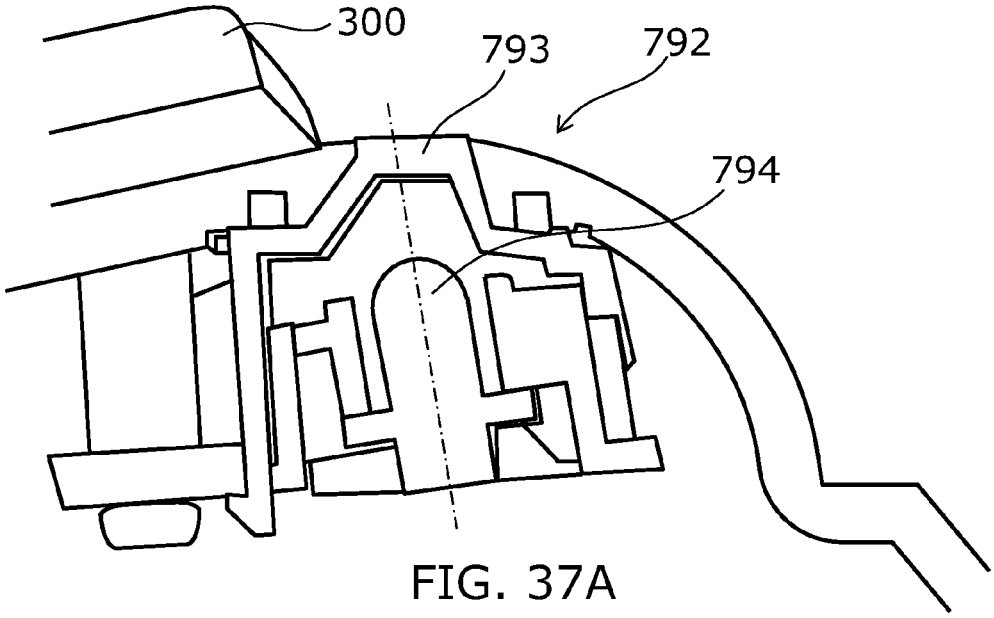
FIG. 37 is a schematic view showing a cross section of the lamp 792.
Figure 37B:
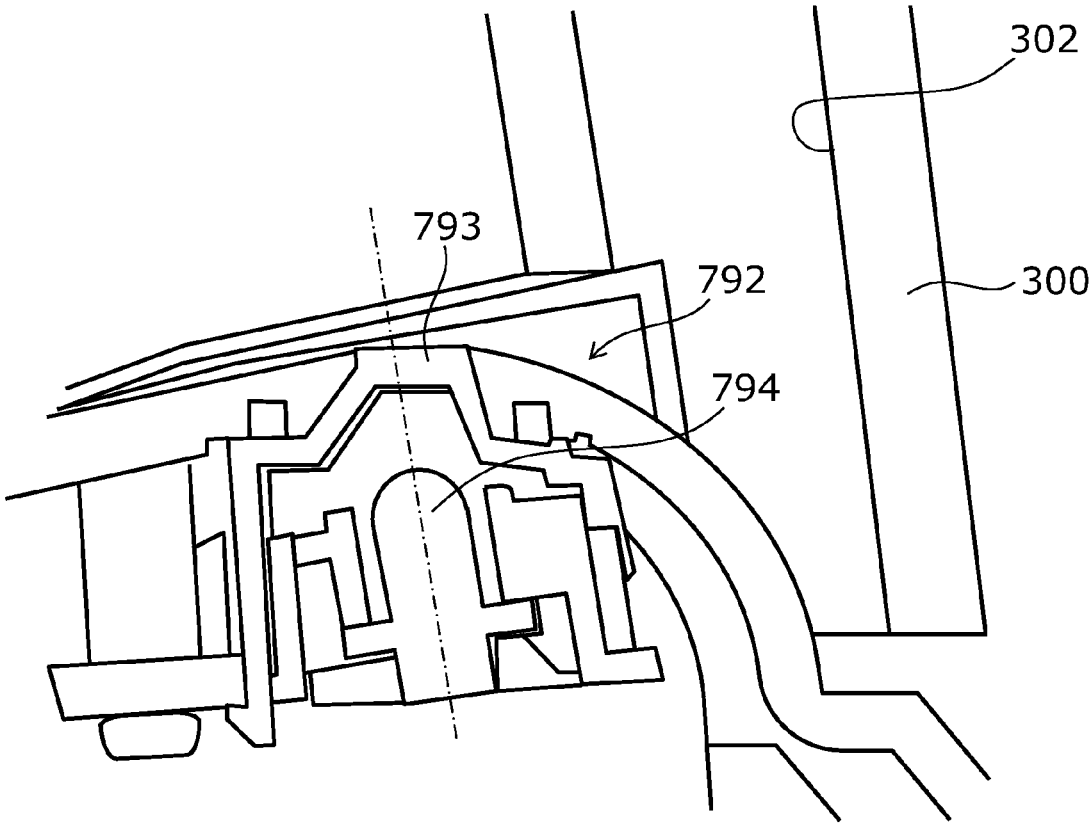

FIG. 37 is a schematic view showing a cross section of the lamp 792. As shown in this figure, the lamp 792 includes an LED (light emitting diode) 794 inside a window 793 embedded in the main body 400 generally coplanar with the surface of thereof. Light emitted from the LED 794 is extracted through the window 793 toward the ceiling of the toilet room. This light is extracted outside whether in the closed state of the toilet lid 300 as shown in FIG. 37A or in the opened state of the toilet lid 300 as shown in FIG. 37B, and can provide a user with soothing illumination. The lamp 792 can also serve to inform the user by blinking during preparation for operation, for example.

According to this embodiment, the toilet lid 300 is maintained in the forward-leaning posture when it is fully opened, thereby achieving an effect of efficiently reflecting light from the lamp 792. More specifically, as shown in FIG. 37B, in the opened state of the toilet lid 300, the lamp 792 is located in front of the toilet lid 300 (see FIG. 23). That is, in the opened state of the toilet lid 300, light is emitted in front thereof from the lamp 792. According to this embodiment, part of this light can be reflected by the backside 302 of the toilet lid 300.

Figure 38:
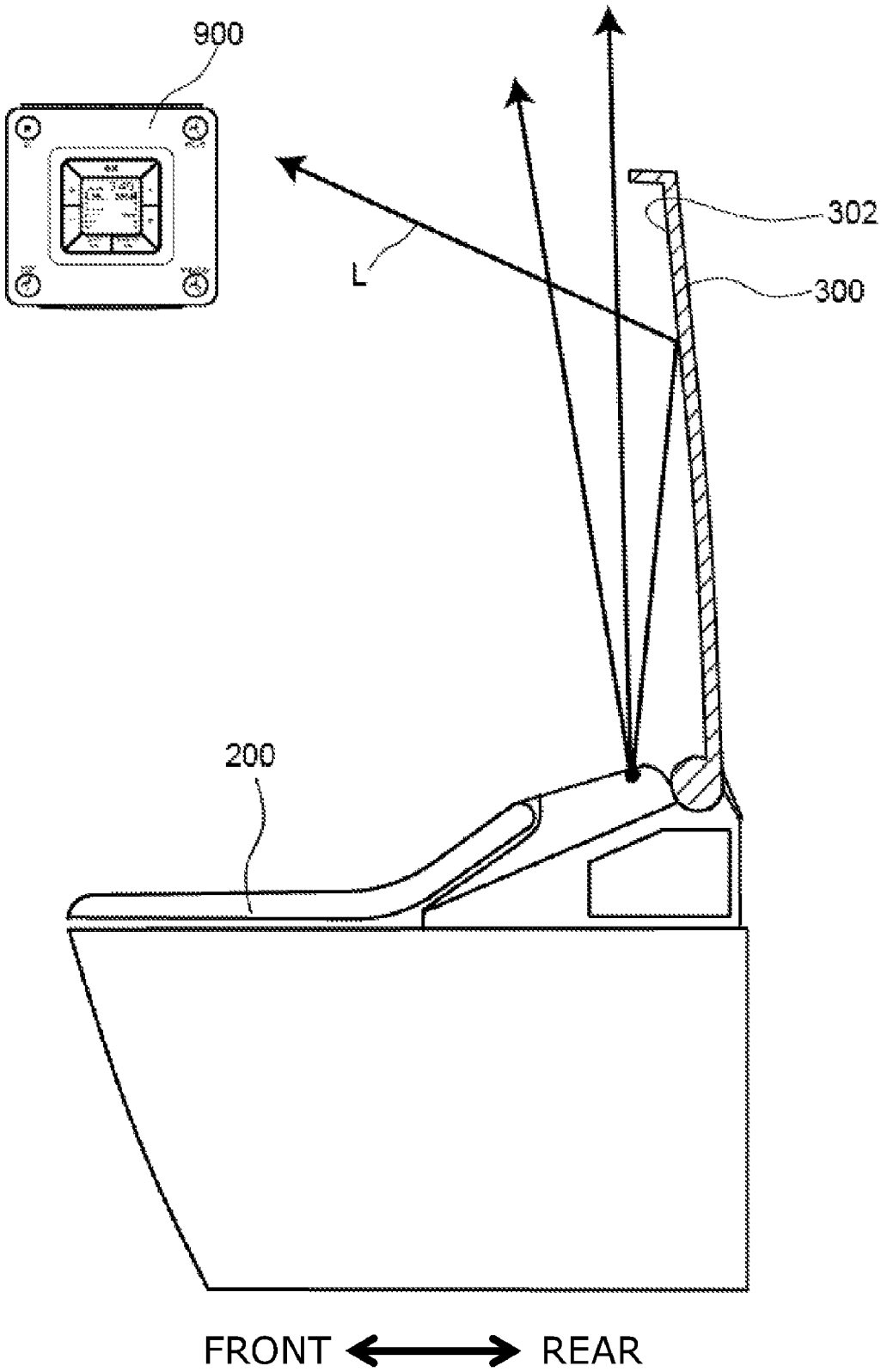
FIG. 38 is a schematic view for illustrating the path of light emitted from the lamp 792.

FIG. 38 is a schematic view for illustrating the path of light emitted from the lamp 792.

In this embodiment, the toilet lid 300 leans forward in its opened state. Hence part of the light L emitted from the lamp 792 is reflected by the backside 302 of the toilet lid 300 and spreads forward. Likewise, the light is reflected also by the inner surface of the sidewall 303 (see FIG. 1) bent upright around the toilet lid 300. Thus the light L reflected by the backside 302 of the toilet seat and the inner surface of the sidewall 303 illuminates the remote controller 900 provided on the wall of the toilet. That is, as viewed from a user sitting on the toilet seat 200, the control panel of the remote controller 900 can be irradiated with soft light from behind. Toilet illumination may be often dazzling to a user who wakes up during sleep and uses the toilet at night. According to this example, even in such a case, the light emitted from the lamp 792 provided in the main body 400 can be effectively reflected by the forward-leaning toilet lid 300 to illuminate the control panel of the remote controller 900 with moderate brightness, thereby enabling comfortable use.

Next, the structure of the toilet seat apparatus 100 of this example is described in more detail.

Figure 39:
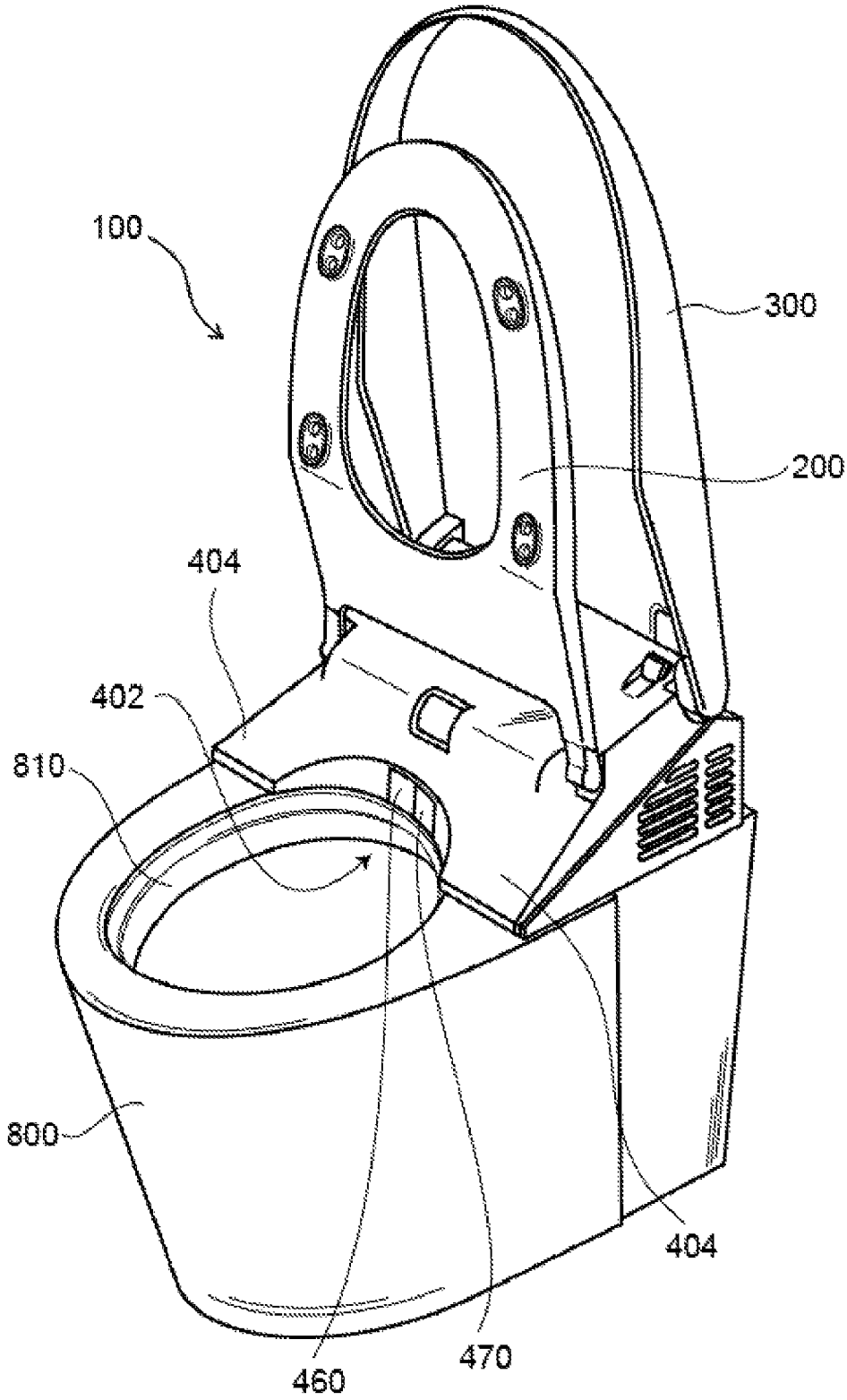
FIG. 39 is a schematic view showing the toilet seat apparatus 100 of this example in the opened state of the toilet lid 300 and the toilet seat 200.

FIG. 39 is a schematic view showing the toilet seat apparatus 100 of this example in the opened state of the toilet lid 300 and the toilet seat 200.

In this example, the main body 400 has a configuration retracted to fit the opening edge of the bowl 810 of the toilet bowl 800. That is, the main body 400 is placed at the upper rear of the toilet bowl 800, and its front is formed into a curved concave surface 402 that is concavely curved along the shape of the opening edge of the bowl 810 of the toilet bowl 800 so as to slightly protrude from the opening edge of the bowl 810 toward the bowl 810. Extensions 404 extending forward along the opening edge of the bowl 810 are provided on the left and right of the curved concave surface 402. The curved concave surface 402 has a configuration that is elevated in its center vicinity and gradually lowered toward the extensions 404.

The elevated portion in the center vicinity of the curved concave surface 402 is provided with an opening for advancing and retracting the water discharge nozzle and a nozzle damper 460 serving as a closing member for covering the opening. On its right side, a warm air blowout port and a warm air damper 470 serving as a closing member for covering the warm air blowout port are provided. These are all reclosably supported, and all in the closed state during standby. When the water discharge nozzle advances for cleansing the "bottom" of a user sitting on the toilet seat 200, the nozzle damper 460 is opened. When warm air is blown from the warm air unit 620 toward the "bottom" of a user, the warm air damper 470 is opened.

By retracting the front of the main body 400 to form a curved concave surface 402, urine is unlikely to splash thereon even during male standing urination, and no visual narrowness is inflicted on the user. By elevating the center vicinity of the curved concave surface 402, the elevated portion in the center vicinity of the curved concave surface 402 can receive urine and drop it into the bowl 810 even if urine splashes on the main body 400 during male standing urination. That is, it is possible to prevent urine from splashing on the slope 408 of the main body 400 and to minimize dirt due to urine.

Furthermore, by thus retracting the main body 400, it is also possible to prevent the attachment of dirt to the backside of the main body 400 and to significantly improve cleanability. More specifically, according to this example, a user squatting down in front of the toilet bowl 800 can see close to the upper edge of the rear-end rim of the bowl 810. Thus the user, remaining in this posture, can clean the bowl 810 up to its rear end using a cloth or brush and reliably and easily confirm that any dirt has been cleaned off. Furthermore, in this embodiment, the amount of protrusion of the main body 400 to above the bowl 810 is held down. Hence it is also easy to clean dirt attached to the backside of the protrusion. For example, during cleaning with a cloth, the user can apply the cloth to the backside of the main body 400 and quickly wipe it from side to side.

The embodiment of the invention has been described with reference to examples. However, the invention is not limited to these examples. For example, the sanitary cleansing apparatus 100 described above with reference to FIGS. 1 to 39 can achieve the same advantageous effects not only when it is installed on a toilet bowl of the service-water direct-pressure type, but also when it is installed on a toilet bowl equipped with a low tank.

The examples described above with reference to FIGS. 1 to 39 can be combined with each other as long as technically feasible, and such combinations are also encompassed within the scope of the invention.

The structure and operation of the sanitary cleansing apparatus and the toilet apparatus are not limited to those described above with reference to FIGS. 1 to 22, but any suitable modifications made by those skilled in the art for similarly practicing the invention and achieving similar effects are also encompassed within the scope of the invention as long as they include the features of the invention.

INDUSTRIAL APPLICABILITY

This invention can provide a sanitary cleansing apparatus that can be substantially entirely covered with a toilet lid and that can also reliably perform human body detection, and a toilet apparatus provided therewith.

Furthermore, this invention can provide a toilet seat apparatus capable of preventing collision with an object therebehind at the time of opening the toilet lid, and a toilet apparatus provided therewith.

The invention claimed is:

1. A sanitary cleansing apparatus comprising:

a main body incorporating a water discharge nozzle that squirts water from a water discharge port;

a toilet seat rotatably and pivotally supported at a relatively anterior position of the main body;

a toilet lid rotatably and pivotally supported at a relatively posterior position of the main body and entirely covering an upper face of the toilet seat and an upper face of the main body in a closed state;

a transmissive window provided at a rear of the toilet lid, the transmissive window being confined within a periphery of the toilet lid and formed from a material different from that of the toilet lid; and a human body detection sensor provided in the upper face of the main body and being capable of detecting a human body through the transmissive window in the closed state of the toilet lid.

2. The sanitary cleansing apparatus according to claim 1, wherein the human body detection sensor includes a lens for focusing infrared radiation emitted from the human body and a pyroelectric element for detecting the infrared radiation.

3. The sanitary cleansing apparatus according to claim 2, wherein a recessed portion is provided in the upper face of the main body, and at least a portion of the lens is embedded in the recessed portion.

4. A sanitary cleansing apparatus comprising:

a main body incorporating a water discharge nozzle that squirts water from a water discharge port;

a toilet seat rotatably and pivotally supported at a relatively anterior position of the main body;

a toilet lid rotatably and pivotally supported at a relatively posterior position of the main body and entirely covering an upper face of the toilet seat and an upper face of the main body in a closed state;

a transmissive window provided at a rear of the toilet lid, the transmissive window being confined within a periphery of the toilet lid and formed from a material different from that of the toilet lid, the transmissive window including a window portion thinner than the toilet lid; and a human body detection sensor provided in the upper face of the main body and being capable of detecting a human body through the transmissive window in the closed state of the toilet lid, wherein the human body detection sensor includes a lens for focusing infrared radiation emitted from the human body and a pyroelectric element for detecting the infrared radiation, a recessed portion that is recessed relative to its surroundings is provided in the upper face of the main body, at least a portion of the lens is embedded in the recessed portion, and another portion of the lens protrudes from the main body, and the lens of the human body detection sensor is placed below the window portion of the transmissive window in the closed state of the toilet lid.

5. The sanitary cleansing apparatus according to claim 3 or 4, wherein the transmissive window is removably installed on the toilet lid.

6. The sanitary cleansing apparatus according to claim 5, wherein the toilet lid includes an opening provided at its rear edge, a rail is provided on one of a side face of the transmissive window and a sidewall of the opening, a rail groove is provided on the other of the side face of the transmissive window and the sidewall of the opening, an the transmissive window can be installed on the toilet lid by being slid with the rail engaged with the rail groove.

7. The sanitary cleansing apparatus according to claim 6, wherein an engaging protrusion is provided on one of the transmissive window and the opening, an engaging recess is provided on the other of the transmissive window and the opening, and the engaging protrusion is engaged with the engaging recess when the transmissive window is installed on the toilet lid.

8. A toilet apparatus comprising:

a sit-down toilet bowl; and the sanitary cleansing apparatus according to claim 1.

9. The toilet apparatus according to claim 8, wherein the main body is internally equipped with an electrically-driven toilet lid opening/closing device for opening/closing the toilet lid and a toilet bowl washing valve for controlling supply of wash water to the sit-down toilet bowl, and the human body detection sensor is provided above one of the electrically-driven toilet lid opening/closing device and the toilet bowl washing valve.

10. The toilet apparatus according to claim 8, wherein an electrically-driven toilet lid opening/closing device for opening/closing the toilet lid is provided in the main body, and the toilet bowl washing valve and the electrically-driven toilet lid opening/closing device are adjacently placed at a rear of the main body.

11. The toilet apparatus according to claim 8, wherein a step is provided on a side face of the main body, in the closed state of the toilet lid, a side face of the toilet lid fits the step, and the side face of the main body and the side face of the toilet lid form a generally continuous common surface.

12. The toilet apparatus according to claim 8, wherein in the closed state of the toilet lid, the upper face of the main body is in proximity to the toilet lid.

13. The toilet apparatus according to claim 8, further comprising:

a stopper for stopping opening the toilet lid in a state where center of gravity of the toilet lid is located on closed side of vertically upward direction above an axis of the rotation of the toilet lid; and an elastic body for biasing the toilet lid to opened side.

14. The toilet apparatus according to claim 13, wherein in the state of the toilet lid being stopped by the stopper, the toilet lid leans to the closed side.

15. The toilet apparatus according to claim 13, wherein in the state of the toilet lid being stopped by the stopper, torque by a biasing force of the elastic body is larger than torque by weight moment of the toilet lid.

16. The toilet apparatus according to claim 13, wherein the main body includes a light-receiving window provided behind the pivotal support of the toilet lid for receiving a signal transmitted from a remote controller.

* * * * *